US009913030B2

(12) United States Patent
Bernardini et al.

(10) Patent No.: US 9,913,030 B2
(45) Date of Patent: Mar. 6, 2018

(54) BEAMFORMING METHOD BASED ON ARRAYS OF MICROPHONES AND CORRESPONDING APPARATUS

(71) Applicant: STMicroelectronics S.R.L., Agrate Brianza (IT)

(72) Inventors: Alberto Bernardini, Milan (IT); Matteo D'Aria, Bergamo (IT); Roberto Sannino, Romano di Lombardia (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 15/392,807

(22) Filed: Dec. 28, 2016

(65) Prior Publication Data

US 2017/0374454 A1 Dec. 28, 2017

(30) Foreign Application Priority Data

Jun. 23, 2016 (IT) ..... 102016000065331

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/403* (2013.01)

(58) Field of Classification Search
CPC ... H04R 3/005; H04R 1/406; H04R 2201/403
USPC ..... 381/92
See application file for complete search history.

(56) References Cited

U.S. PATENT DOCUMENTS

2014/0270248 A1* 9/2014 Ivanov ..... H04R 3/005 381/92

FOREIGN PATENT DOCUMENTS

WO 2010/116153 A1 10/2010
WO 2011/010292 A1 1/2011

OTHER PUBLICATIONS

Balanis, *Antenna Theory—Analysis and Design*, Third Edition, John Wiley & Sons, Hoboken, New Jersey, 2005, 1072 pages.

(Continued)

*Primary Examiner* — Paul S Kim
(74) *Attorney, Agent, or Firm* — Seed IP Law Group LLP

(57) ABSTRACT

A beamforming method employs a plurality of microphones arranged in an array with respect to a reference point. The method includes acquiring microphone signals from the microphones and combining the microphone signals (x1 . . . xM) to obtain Virtual Microphones, combining the microphone signals to obtain a pair of directional Virtual Microphones having respective signals determining respective patterns of radiation with a same origin corresponding to the reference point and rotated at different pattern direction angles, defining a separation angle between them, obtaining a sum radiation signal of a sum Virtual Microphone with a sum radiation pattern, associating a respective weight to the signals of the pair of directional Virtual Microphones, obtaining respective weighted signals of radiation and summing the weighted signals, computing respective weights as a function of a determined pattern direction angle of the pattern of radiation of the pair of directional Virtual Microphones and of the separation angle.

20 Claims, 16 Drawing Sheets

(56) References Cited

OTHER PUBLICATIONS

Benesty et al., *Study and Design of Differential Microphone Arrays*, First Edition, Springer-Verlag Berlin Heidelberg, 2013, 184 pages.
Benesty et al., *Design of Circular Differential Microphone Arrays*, First Edition, Springer International Publishing, 2015, 166 pages.
De Sena et al., "On the Design and Implementation of Higher Order Differential Microphones," *IEEE Transactions on Audio, Speech, and Language Processing 20*(1):162-174, Jan. 2012.
Do et al., "A Real-Time SRP-PHAT Source Location Implementation Using Stochastic Region Contraction(SRC) on a Large-Aperture Microphone Array," IEEE International Conference on Acoustics, Speech and Signal Processing (ICASSP '07), Apr. 15-20, 2007, Honolulu, HI, vol. 1, pp. I-121-I-124.
Elko, "Differential Microphone Arrays," in Huang et al. (eds.), *Audio Signal Processing for Next-Generation Multimedia Communication Systems*, Kluwer Academic Publishers, 2004, 65 pages.
Elko et al., "A Steerable and Variable First-Order Differential Microphone Array," IEEE International Conference on Acoustics, Speech, and Signal Processing (ICASSP '97), Apr. 21-24, 1997, Munich, vol. 1, pp. 223-226.
Zhang et al., "Study of nonuniform linear differential microphone arrays with the minimum-norm filter," *Applied Acoustics 98*:62-69, 2015.

* cited by examiner

BEAMFORMING METHOD BASED ON ARRAYS OF MICROPHONES AND CORRESPONDING APPARATUS

BACKGROUND

Technical Field

The present description relates to beamforming based on a plurality of microphones arranged in an array or arrays with respect to a reference point, including acquiring microphone signals issued by said plurality of microphones, which may be preferably applied to sound source localization.

Description of the Related Art

It is very well known to use arrays of microphones to perform sound, or acoustic, source localization, i.e., locating a sound source given measurements of the sound field, which in particular are obtained by such microphones.

It is also known to use signal processing modules such as DSP (Digital Signal Processing) modules to process the signals from each of the individual microphone array elements to create one or more Virtual Microphones (VMIC).

Virtual Microphones (VMIC) are therefore a combination of filtered versions of the signals sensed by an array of microphones arranged in a particular spatial geometry.

Virtual Microphones may be obtained in a recursive fashion using combinations of other Virtual Microphones organized in virtual arrays. Therefore, in general, a Virtual Microphone is characterized by a hierarchical virtual structure with a number L greater equal than one of layers: the first layer combines physical microphone signals generating an array of Virtual Microphones and any higher layer combines Virtual Microphone signals forming further arrays of Virtual Microphones.

For what concerns the Virtual Microphone position, considering an array of virtual or physical microphones, the array is geometrically described with respect to a fixed reference point in the physical space: the Virtual Microphone resulting from the combination of microphone signals of this array is virtually positioned in the same fixed reference point of the array.

For what regards a general polar pattern function, a Virtual Microphone is characterized by an omnidirectional or directive polar pattern or directivity pattern.

An N-th order frequency-independent microphone directivity pattern $\Gamma(\theta)$ is defined as:

$$\Gamma(\theta)=a_0+a_1\cos(\theta)+a_2\cos^2(\theta)+\ldots+a_N\cos^N(\theta)$$

$\theta$ being the polar angle, $0<\theta\leq 2\pi$, and $a_0, \ldots, a_N$ coefficients of the pattern.

It is convenient to set such coefficients as follows:

$$a_0=1-a_1-a_2-\ldots-a_N$$

so that it is obtained a directivity pattern:

$$\Gamma(\theta)=1-\sum_{i=1}^{N}a_i+\sum_{i=1}^{N}a_i\cos^i(\theta)$$

In the following a Virtual Microphone characterized by a polar pattern of the N-th order will be referred to as an N-th order Virtual Microphone.

Directive Virtual Microphones are known. Known DSP techniques allow building directive Virtual Microphones of any order starting from arrays of (physical) omnidirectional microphones. Two broad classes of such DSP techniques are known as:

filter and sum techniques;

Differential Microphone Array techniques.

Differential Microphone Arrays (DMAs) are built by subtracting from each other the delayed microphone signals of the array.

The delays can be tuned in order to obtain a Virtual Microphone with the desired polar pattern shape, according to well known design principles.

The two broadest classes of DMAs with uniform geometries are:

Uniform Linear Arrays (ULA); and

Uniform Circular Arrays (UCA).

Also Linear DMAs with non-uniform geometries have been discussed.

In a First Order Differential ULA, shown schematically in FIG. 1, an array 11 is constituted of two physical omnidirectional microphones M1, M2, supplying a pair of microphone signals ($m_{-d/2}$, $m_{d/2}$), positioned at a distance d one with respect to the other. A reference point O of the array is placed at the origin of the z-y Cartesian diagram. A sound wave of pressure amplitude P0 and frequency $\omega$ propagates along a propagation vector kin direction of such array. With $\theta$ is indicated the direction angle, i.e., the angle between the propagation vector k and the horizontal axis z of the array of microphones. The pair of microphone signals ($m_{-d/2}$, $m_{+d/2}$) is subtracted in a subtraction node 13, after applying to one of the two signals in a delay module 12 a delay $\tau$. Varying $\tau$ the designer can adjust the resulting polar pattern shape.

The delay module 12 and subtraction node 13 identify a Virtual microphone 15 structure, having as input the pair of microphone signals ($m_{-d/2}$, $m_{+d/2}$) and as output a first order Virtual Microphone is obtained generating a virtual Microphone signal V(t), in particular here the resulting first order Virtual Microphone signal $V_1(t)$ is expressed as:

$$V_1(t)=m_{+d/2}(t-\tau)-m_{-d/2}(t)$$

A filter 14, Hc($\omega$), is provided at the output of the virtual microphone structure 15 to operate on the Virtual Microphone signal $V_1(t)$, which is a correction filter (i.e., low pass filter), applied to the Virtual Microphone $V_1(t)$ signal in order to compensate for the frequency dependent effect of the signal subtraction.

The distance d between the microphones of the array 11 must be small enough with respect to the wavelength of the signal so that it can be considered negligible.

The shape of the polar pattern will be almost constant over a broad range of frequencies.

The polar pattern coefficient $a_1$ is related to the delay $\tau$ by the formula:

$$\tau=\frac{a_1-1}{a_1}\frac{d}{c_s}$$

where $c_s$ is the speed of sound.

In FIG. 2 it is shown a structure producing as a result a second order Virtual Microphone. As it can be seen the structure of FIG. 1 of first order Virtual Microphone with a pair of microphones, which signals are sent to a difference module, is replicated. Three microphones M1, M2, M3 define two pairs of microphones at level L1 with two first order Virtual Microphones $\mathbf{15}_1$, including a delay and a difference module, like in FIG. 1, while at level L2 another corresponding Virtual Microphones $\mathbf{15}_2$, collects the output of such first order Virtual Microphones $15_1$ operating the same delay and difference operations, although the delay value can be different. The chain is concluded, like in FIG. 1, by the filter 14. As mentioned, a first delay $\tau 1$, associated to the delay module of level L1, and a second delay $\tau 2$, associated to the delay module of level L2, can be tuned by the designer in order to obtain a Virtual Microphone with arbitrary directive polar pattern of the second order Setting the polar pattern coefficients $a_1=\eta_1+\eta_2-2\eta_1\eta_2$ and $a_2=\eta_1\eta_2$ it is obtained for the delays:

$$\tau_1 = \frac{(\eta_1 - 1)}{\eta_1} * \frac{d}{c_s}$$

and $$\tau_2 = \frac{(\eta_2 - 1)}{\eta_2} * \frac{d}{c_s}$$

In FIG. 3 it is shown a third order Virtual Microphone structure $15_3$, from an array of microphones 11 including four microphones M1, M2, M3, M4 which is characterized by a three levels L1, L2, L3 hierarchical virtual structure.

With reference to FIG. 4, it is possible to derive N-th order Virtual Microphones also with the alternative recently developed class of Differential Uniform Circular Arrays (UCA). UCAS are characterized by the spatial geometry depicted in FIG. 4, where the microphones, M1, M2 . . . Mm . . . MM, with M being the number of microphones, are uniformly displaced on a circumference at positions identified by angles $\psi_m$, defining an array 21. In particular, in FIG. 4 with $\psi_m$ is indicated the angle corresponding to the generic m-th microphone Mm. For deeper understanding of UCAs it is here made reference to the book "*Design of Circular Differential Microphone Arrays*", Benesty, Jacob, Jingdong, Chen, Cohen, Israel, Springer Verlag, 2015.

It is here underlined the fact that, indicating with N the number of Virtual Microphones obtained by M physical microphones, the maximum polar pattern order obtainable with an UCA is Nmax=M/2, which means that with M=2 or M=3 microphones it can be derived up to a first order Virtual Microphone; with M=4 or M=5 microphones it can be derived up to a second order Virtual Microphone; with M=6 or M=7 microphones it can be derived up to a thirst order Virtual Microphone; and so on. The higher the number M of microphones, the more robust is the DMA array. It is possible doing steering in all the M directions identified by the angle $\psi_m$.

Virtual Microphone polar patterns have always a symmetric shape with respect to the z axis. If it is desired only one main lobe in the directivity pattern, for ULA arrays it must aim at 0 degrees or at 180 degrees only.

Also polar patterns of Virtual Microphones obtained using differential UCA arrays are symmetric with respect to an axis, since a symmetry constraint is always applied in the derivation.

The symmetry axis may be any of the M straight lines joining the center of the array and the M microphones. In general it is not possible to design the Virtual Microphone polar pattern with the main lobe aiming at a direction different from angle $\psi_m$ at which each of the M microphones is set, with $1 \leq m \leq M$. As explained in the above mentioned publication by Benesty et al., applying super-directive beamforming to UCA and getting rid of the symmetry constraint it is possible to design Virtual Microphones aiming at arbitrary directions, but the shape of the resulting polar pattern strongly depends on the main lobe direction. All these considerations apply in relation to a two-dimensional array.

Although arbitrary order Differential Microphone Array (DMA) based systems with Virtual Microphones steerable in arbitrary directions would be highly desirable for localization purposes, however using known DMAs, doing steering in arbitrary directions with arbitrary order Virtual Microphones characterized by polar patterns with shapes comparable to each other is not possible, so continuous steering is infeasible. Doing steering with identical polar patterns of any order is possible only for a discrete set of directions:

0 degrees and 180 degrees for ULAs; and angle $\psi_m$ with $1 \leq m \leq M$ for UCAs.

BRIEF SUMMARY

Various embodiments refer to beamforming apparatuses and likewise to a computer program product that can be loaded into the memory of at least one computer (e.g., a terminal in a network) and comprises portions of software code suitable for carrying out the steps of the method when the program is run on at least one computer. As used herein, the aforesaid computer program product is understood as being equivalent to a computer-readable medium containing instructions for control of the computer system so as to co-ordinate execution of the method according to embodiments of the present disclosure. Reference to "at least one computer" is meant to highlight the possibility of embodiments of the present disclosure being implemented in a modular and/or distributed form.

In various embodiments a beamforming method employs a plurality of microphones arranged in arrays with respect to a reference point, including, acquiring microphone signals issued by said plurality of microphones and combining said microphone signals to obtain Virtual Microphones, combining said microphone signals to obtain at least a pair of directional Virtual Microphone having respective signals determining respective patterns of radiation with a same origin corresponding to said reference point of the array and rotated at different pattern direction angles, defining a separation angle between them so that at least a circular sector is defined between said different pattern direction angles, said separation angle between the at least a pair of Virtual Microphones being lower than $\pi/2$, and obtaining a signal of a sum Virtual Microphone, to which is associated a respective sum radiation pattern, associating a respective weight to the signals of said pair of directional Virtual Microphones, obtaining respective weighted signals and summing said weighted signals, computing said respective weights as a function of a determined pattern direction angle, of the pattern of radiation of said pair of directional Virtual Microphones and of the separation angle so that a main lobe of said sum radiation pattern is steered within said circular sector to point in the direction of said determined pattern direction angle.

In various embodiments, the method further includes arranging said array as a Differential Microphone Array, in particular a Uniform Linear Array or a Uniform Circular Array.

In various embodiments, the method described further includes steering in said circular sector the pattern direction angle of said sum radiation pattern to obtain a sound source location estimate, and obtaining said sound source location estimate selecting the direction on which the power of the signal of said sum Virtual Microphone is maximized.

In various embodiments, the method further includes after combining said microphone signals to obtain Virtual Microphones, ranking the power of the signals of said Virtual Microphones, selecting a main circular sector defined by two adjacent virtual microphones on the basis of said ranking results, performing a continuous steering of the direction angles of said sum Virtual Microphone in said selected main circular sector to find said sound source location estimate.

In various embodiments, the method further includes that said ranking includes obtaining a ranking list as a function of power of the virtual microphones starting from a virtual microphone which maximizes the power, said selecting a main circular sector includes selecting said virtual microphone which maximizes the power and, among the virtual microphones adjacent to said microphone, selecting the virtual microphone associated with the maximum power, defining the main circular sector as the sector comprised between the said virtual microphone which maximizes the power and said adjacent microphone.

In various embodiments, the method further includes that the power is the Teager energy of the signal of the Virtual Microphone measured over a given time-frame of a given number of samples.

In various embodiments a beamforming apparatus comprises a plurality of directional microphones arranged as an array, comprising at least a module configured to: acquire microphone signals issued by said plurality of microphones; combine said microphone signals to obtain Virtual Microphones, said module being further configured to providing said plurality of microphones as an array of microphones, combining said microphone signals to obtain at least a pair of directional Virtual Microphones having respective patterns of radiation with a same origin corresponding to said reference point of the array and rotated at different pattern direction angles so that at least a circular sector is defined between said different pattern direction angles; to obtain a sum signal of a sum Virtual Microphone, to which is associated a respective sum radiation pattern, associating a respective weight to the signals of said pair of directional Virtual Microphones, obtaining respective weighted signals and summing said weighted signals, computing said respective weights as a function of a determined pattern direction angle, of the pattern of radiation of said pair of directional Virtual Microphones and of the separation angle so that a main lobe of said sum radiation pattern is steered within said circular sector to point in the direction of said determined pattern direction angle.

In variant embodiments the described beamforming apparatus is included in a source localization apparatus and is configured to steer in said circular sector the pattern direction angle of said sum radiation pattern to obtain a sound source location estimate, obtaining said sound source location estimate choosing the direction on which the power of the signal of said sum Virtual Microphone is maximized.

BRIEF DESCRIPTION OF THE SEVERAL VIEWS OF THE DRAWINGS

The solution will now be described purely by way of a non-limiting example with reference to the annexed drawings, in which.

DETAILED DESCRIPTION

Figure 1:
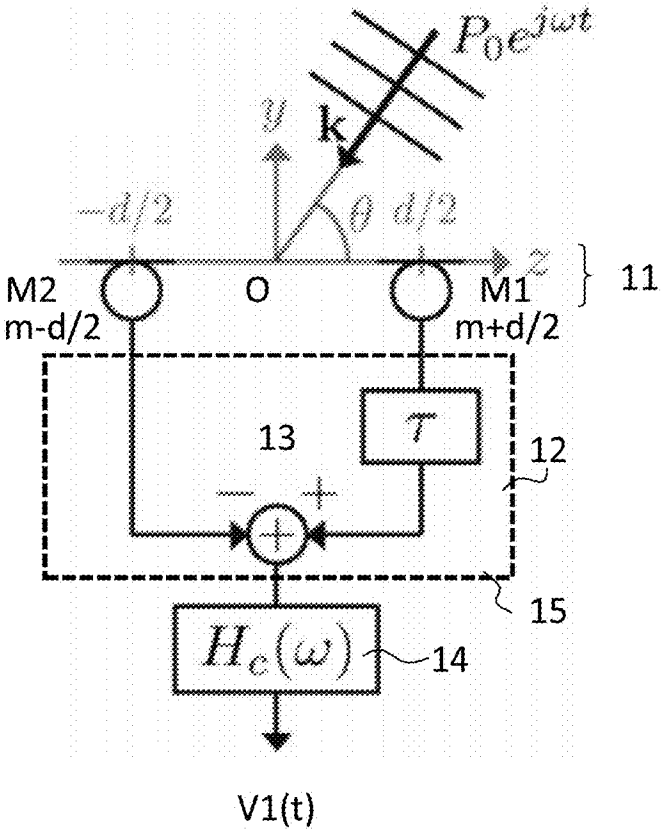
FIG. 1 (Prior Art)
FIGS. 1-4 have been already described in the foregoing description.
Figure 2:
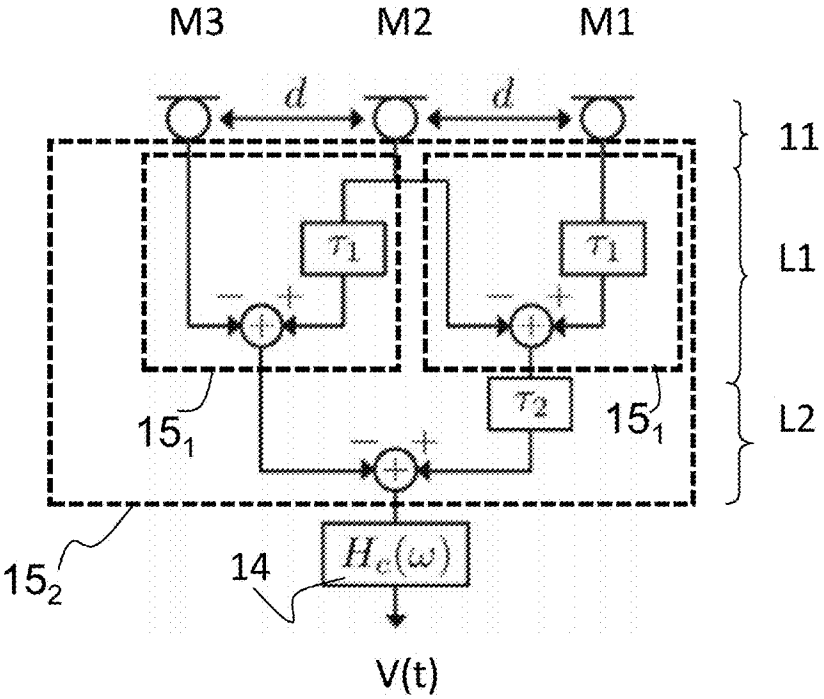
FIG. 2 (Prior Art)
Figure 3:
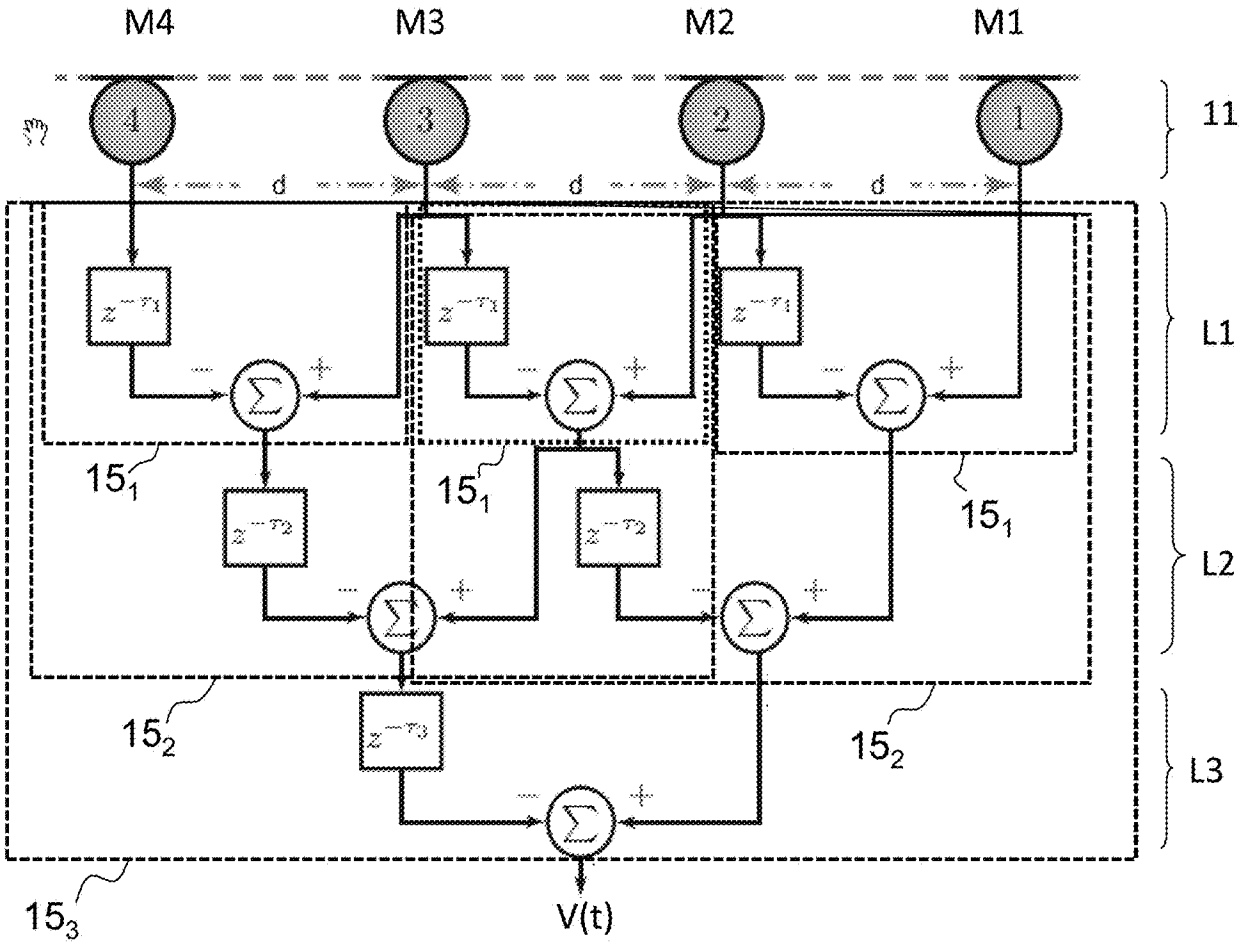
FIG. 3 (Prior Art)

The ensuing description illustrates various specific details aimed at an in-depth understanding of the described embodiments. The embodiments may be implemented without one or more of the specific details, or with other methods, components, materials, etc. In other cases, known structures, materials, or operations are not illustrated or described in detail so that various aspects of the embodiments will not be obscured.

Reference to "an embodiment" or "one embodiment" in the framework of the present description is meant to indicate that a particular configuration, structure, or characteristic described in relation to the embodiment is comprised in at least one embodiment. Likewise, phrases such as "in an embodiment" or "in one embodiment", that may be present in various points of the present description, do not necessarily refer to the one and the same embodiment. Furthermore, particular conformations, structures, or characteristics can be combined appropriately in one or more embodiments.

The references used herein are intended merely for convenience and hence do not define the sphere of protection or the scope of the embodiments.

The method to perform beamforming basing on a plurality of microphones herein described provides acquiring microphone signals from an array of microphones, preferably omni-directional microphones, signals issued by said plurality of microphones and combining said microphone signals to obtain Virtual Microphones, specifically to obtain at least a pair of directional Virtual Microphones having respective patterns of radiation with a same origin corresponding to said reference point of the array and rotated at different pattern direction angles so that at least a circular sector, preferably a circular sector of less than 90 degrees, is defined between said different pattern direction angles. Then it is provided to associate a different weight to said respective patterns of radiation, obtaining a sum radiation pattern, which main lobe is orientated according a given pattern direction angle depending from such weights, such sum radiation pattern being associated to a respective sum Virtual Microphone summing one to the other the radiation patterns of the weighted pair, modifying said weights associated to the patterns of radiations to steer in said circular sector the pattern direction angle of said sum radiation pattern to reach a desired direction angle.

Further a variant of such beamforming method to perform source localization is here described. Such beamforming method includes steering in such circular sector the pattern direction angle of said sum radiation pattern to obtain a sound source location estimate and obtaining said location estimate choosing the direction on which the power of the signals of said plurality of virtual microphones is maximized.

This corresponds to steer a Virtual Microphone beam in each direction in a continuous fashion, using non uniform weight concentric arrays of microphones beamforming on pairs of said microphone signals to obtain a plurality of virtual microphones having the same position in space, with different angles of rotation and non-uniform amplitude gains.

The method here described reduces the problem of performing continuous steering from 0 to $2\pi$ (or the needed range of angles) to performing continuous steering in a discrete number of circular sectors. Therefore, it is provided building pairs of adjacent directive virtual microphones defining circular sectors and combining each pair in order to do continuous steering in each corresponding circular sector.

Figure 5:
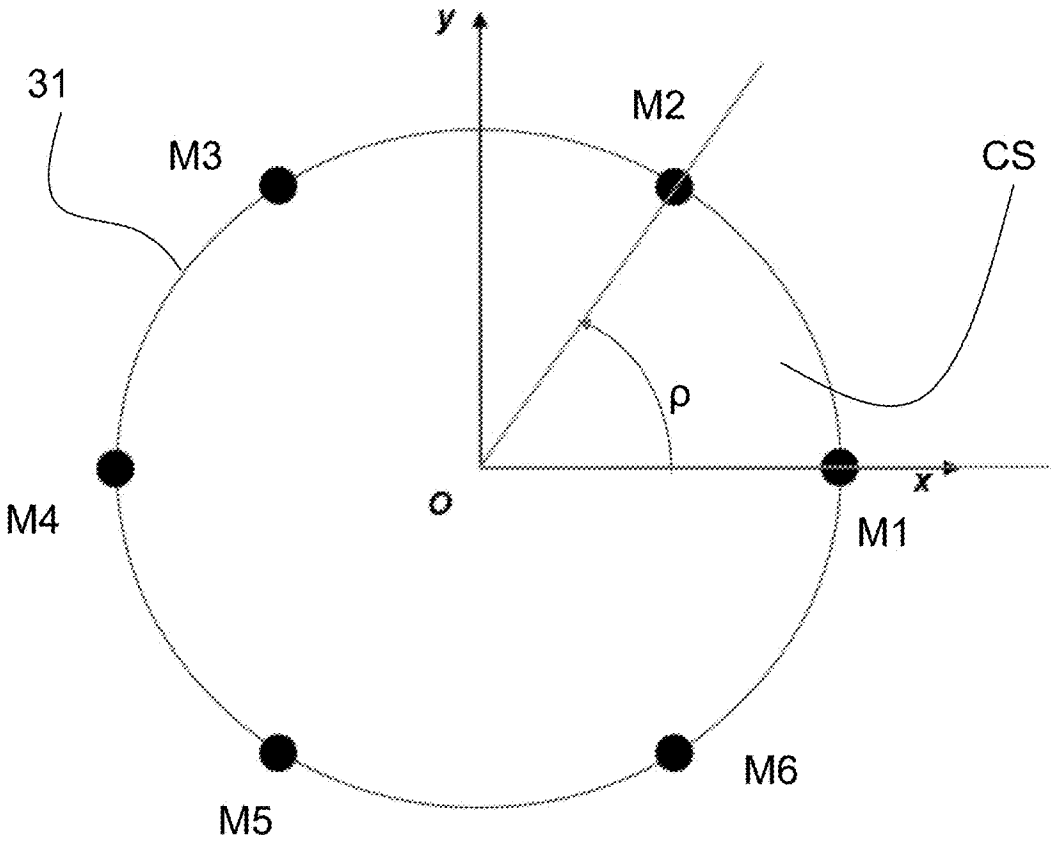
FIG. 5 shows schematically an example of array of microphones which can be used to perform methods according to embodiments of the present disclosure.

In FIG. 5 it is shown an example of geometry of array of omni-directional microphones which can be used to perform the beamforming method here described, using the DMA theory (ULA or UCA) adjacent directive Virtual Microphones defining circular sectors. The needed number of microphones is related to the desired resulting Virtual Microphones order.

In FIG. 5 it is shown an array of microphones 31 comprising a number M=6 of microphones M1 . . . M6 arranged on a circumference at positions spaced of a separation angle $\rho$ of $\pi/3$. The reference point O, where the Virtual Microphones are positioned, is the center of the circumference. Between microphones M1 and M2 is defined a circular sector indicated with CS.

With the geometry of the array 31 it is possible to build six directive first order Virtual Microphones using DMA-ULA theory; six directive (first, second or) third order Virtual Microphones using DMA-UCA theory; defining circular sectors CS with an aperture angle, which corresponds to the separation angle between physical microphones, $\rho=\pi/3$.

Figure 6:
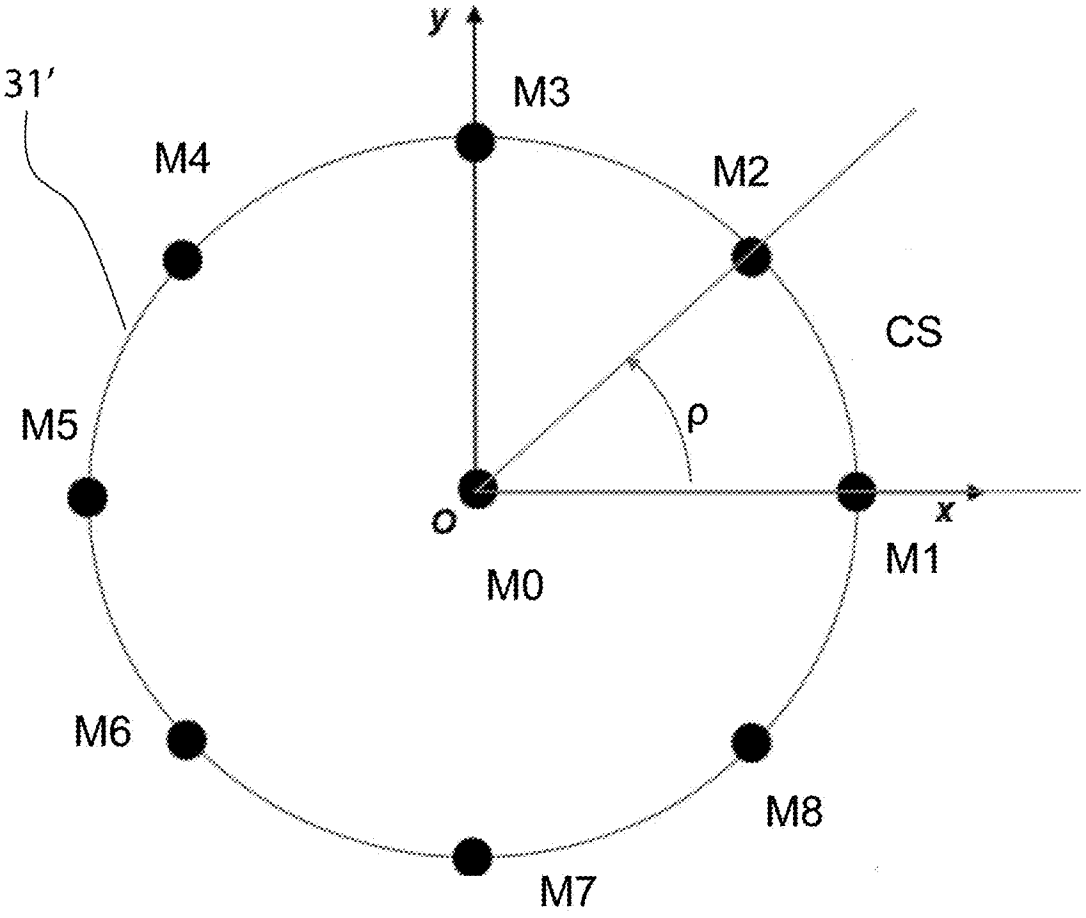
FIGS. 6-8 show schematically further examples of arrays of microphones which can be used to perform methods according to embodiments of the present disclosure.

In FIG. 6 it is shown an array of omni-directional microphones 31' comprising a number M=9 of microphones M1 . . . M9, eight of such microphones being arranged on a circumference at positions spaced by a separation angle $\rho$ of $\pi/4$ and one microphone M9 placed in the center of the circumference, which represents also the reference point O, Between microphones M1 and M2 is indicated a circular sector CS.

With the geometry of array 31' it is possible to build eight directive (first or) second order Virtual Microphones using DMA-ULA theory; eight directive first, second or third order Virtual Microphones using DMA-UCA theory; defining circular sectors of an aperture angle $\rho=\pi/4$.

Figure 7:
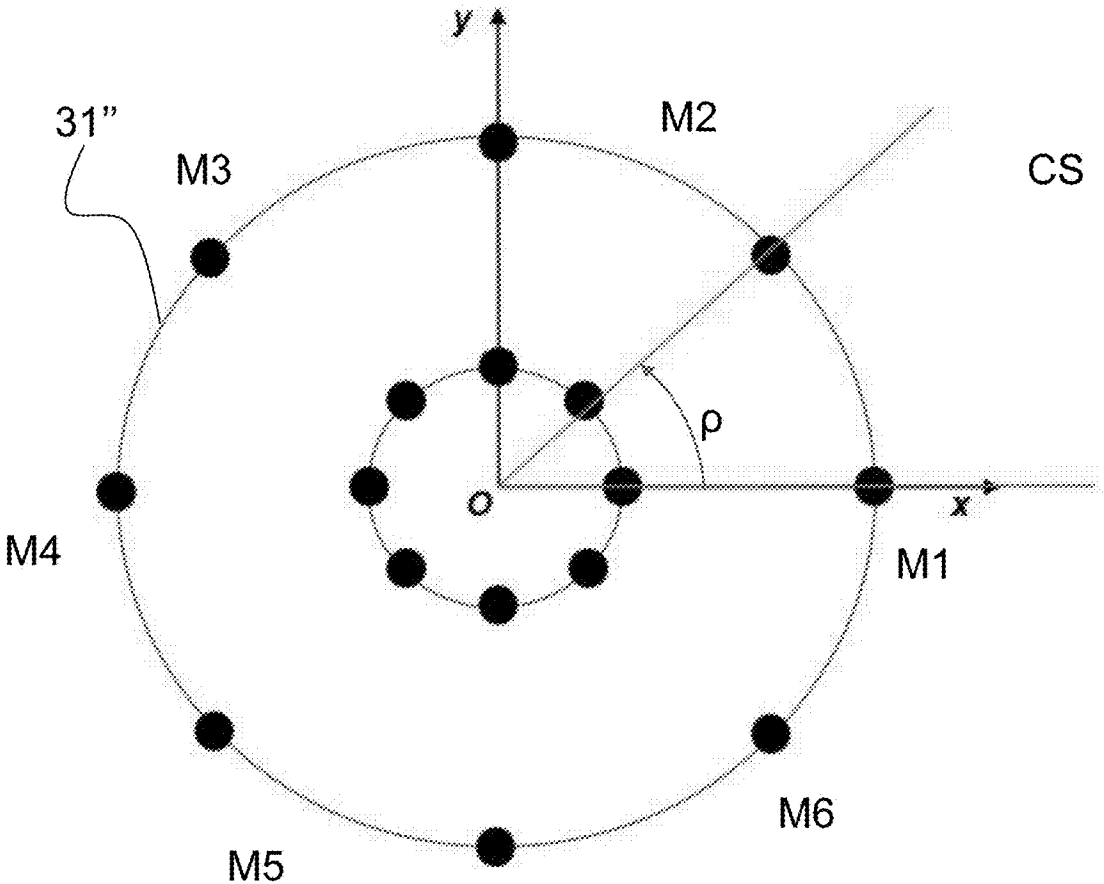

In FIG. 7 it is shown an array of microphones 31" comprising eight microphones on an outer circumference OC and eight microphones on a concentric circumference CC, arranged on the respective circumferences at positions spaced by a separation angle $\rho$ of $\pi/4$.

With the geometry of array 31" it is possible to build eight directive (first or) second order Virtual Microphones using DMA-ULA theory; eight directive first, second or third order Virtual Microphones using DMA-UCA theory; defining circular sectors CS of an aperture angle $\rho=\pi/4$.

Figure 8:
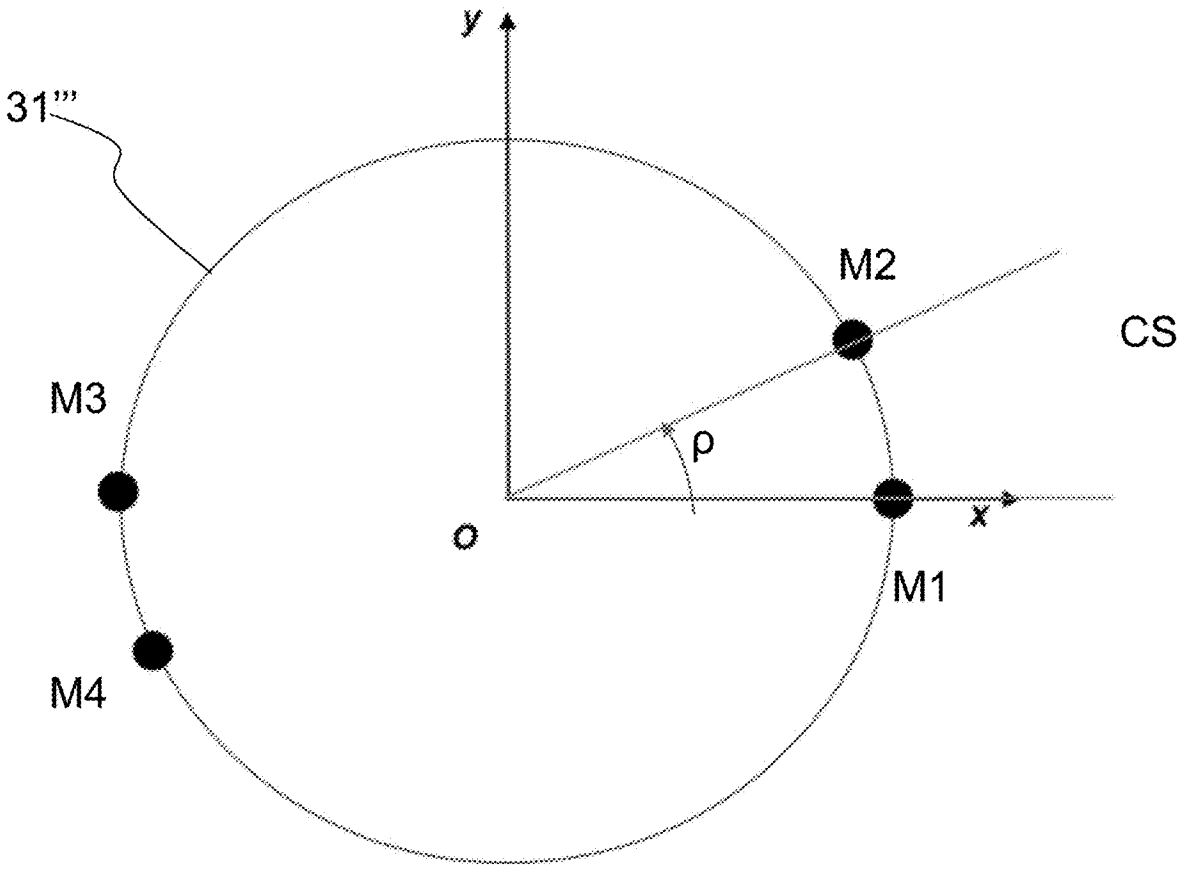

In FIG. 8 it is shown an array of microphones 31''' comprising four microphones arranged on a circumference, M1 and M2 being separate of an angle $\rho$ of $\pi/8$ and M3 and M4 being positioned symmetrically. With the geometry of array 31''' it is possible to build four directive (first or) second order Virtual Microphones using DMA-ULA theory defining circular sectors CS of an aperture angle $\rho=\pi/8$.

Therefore it is possible to provide a variety of geometries of microphone arrays like the ones shown in FIGS. 5-8 which are Non Uniform Weight Concentric Array of physical microphones, with which can be performed beamforming to obtain Virtual Microphones according either to DMA ULA or UCA theory, such Virtual Microphones being located in the center of the circumferences, i.e., in the reference points 0, and their directions separated of a given angle $\rho$, defining circular sectors CS between adjacent pattern directions of Virtual Microphones.

Now, a method for beamforming based on a plurality of microphones arranged as an array with respect to a reference point, the array being for instance either one of those described with reference to FIGS. 5-8, will be described.

Figure 9A:
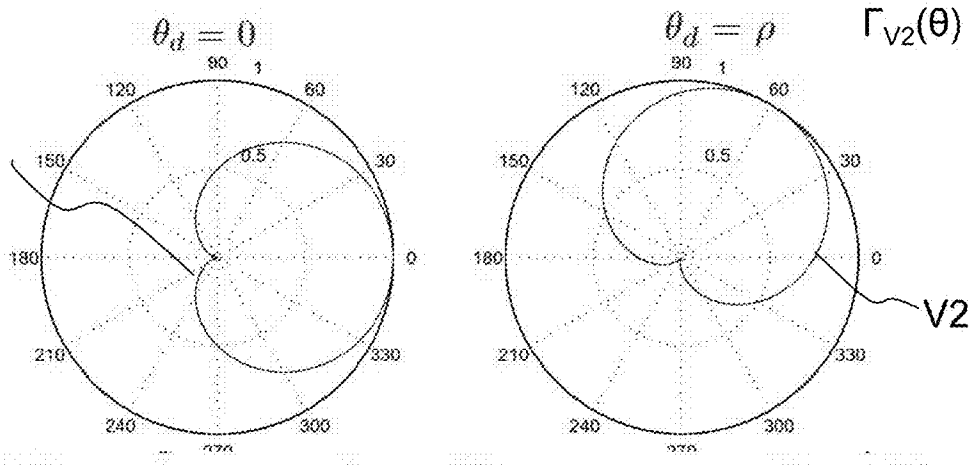
FIG. 9A shows polar patterns of Virtual Microphones obtained by combining microphone signals of microphone arrays according embodiments of the present disclosure.

In FIG. 9A are shown polar patterns of a pair of Virtual Microphones $V_1$ and $V_2$ obtained combining microphone signals of microphones in arrays, for instance in the array of FIG. 8. Considering the circular sector comprised between the two axes identified by direction angles $\theta=0$ and $\theta=\rho$ and considering two directional Virtual Microphones $V_1$ and $V_2$, which are positioned in the same point in the space and focused to the two different directions $\theta=0$ and $\theta=\rho$, the main lobe directions, calculated as angle with respect to the x axis, of the corresponding polar patterns $\Gamma_{V_1}(\theta)$ and $\Gamma_{V_2}(\theta)$ are $\theta=0$ and $\theta=\rho$ respectively.

It is assumed here that Virtual Microphones $V_1$ and $V_2$ are identical and their polar patterns $\Gamma_{V_1}(\theta)$ and $\Gamma_{V_2}(\theta)$ have a symmetric shape. To this regard in FIG. 9A are shown two pattern diagrams representing first order cardioids as an example of two concentric identical Virtual Microphones with desired direction angle $\theta_d=0$ and desired direction angle $\theta_d=\rho$, where $\rho=\pi/3$. However the considerations that follows are valid for two Virtual Microphones $V_1$ and $V_2$ of arbitrary order and arbitrary shape.

In order to perform continuous steering in the defined circular sector of a Virtual Microphone polar pattern, it is obtained a weighted sum of the polar patterns of the pair of Virtual Microphones $V_1$ and $V_2$. The weighted sum of the polar patterns $\Gamma_{V_1}(\theta)$ and $\Gamma_{V_2}(\theta)$ of the two Virtual Microphones $V_1$ and $V_2$ can be written as:

$$\Gamma_{SUM}(\theta)=\alpha_1\Gamma_{V_1}(\theta)+\alpha_2\Gamma_{V_2}(\theta)$$

where $\alpha_1$ is the weight (or gain) multiplying the first polar pattern $\Gamma_{V_1}(\theta)$ and $\alpha_2$ is the weight multiplying the second polar pattern $\Gamma_{V_2}(\theta)$.

Equivalently using the Pattern Multiplication rule:

$$\Gamma_{SUM}(\theta)=\Gamma_{V_1}(\theta)*(\alpha 1+\alpha_2 e^{-j\rho})$$

As a consequence it is also possible to write:

$$\Gamma_{SUM}(\theta)=\alpha_1\Gamma_{V_1}(\theta)+\alpha_2\Gamma_{V_1}(\theta=\phi$$

Then, after obtaining the weighted sum of the polar patterns, still to perform steering in arbitrary directions in a circular sector it is considered the main lobe of the weighted sum pattern $\Gamma_{SUM}(\theta)$ to the generic predetermined desired direction $\theta_d$, with $0 \leq \theta_d \leq \rho$.

It is set a linear constraint $\alpha_1 = \beta\alpha_2$, with $\beta$ a constraint parameter, and it is expressed also the desired direction $\theta_d$ in terms of the same constraint parameter $\beta$:

$$\theta_d = \rho/(\beta+1),$$

This means for instance that if the constraint parameter $\beta$ is equal to 1 the desired direction $\theta_d$ is $\rho/2$.

Therefore, given the desired direction $\theta_d$, the constraint parameter $\beta$ is fixed at the value:

$$\beta = (\rho - \theta_d)/\theta_d$$

Consequently, it is possible to adjust the gains for matching the desired direction $\theta_d$ according to the following formula:

$$\Gamma_{SUM}(\theta_d) = \alpha_2(\beta\Gamma_{V_1}(\theta_d) + \Gamma_{V_1}(\theta_d - \rho))$$

Then it is normalized the polar pattern imposing $\Gamma_{SUM}=1$:

$$1 = \alpha_2(\beta\Gamma_{V_1}(\theta) + \Gamma_{V_1}(\theta - \rho))$$

obtaining that the value of the weight $\alpha_2$ is:

$$\alpha_2 = \frac{1}{\beta\Gamma_{V_1}(\vartheta_d) + \Gamma_{V_1}(\vartheta_d - \rho)} \quad (1)$$

Then:

$$\alpha_1 = \beta\alpha_2 \quad (2)$$

Figure 9B:
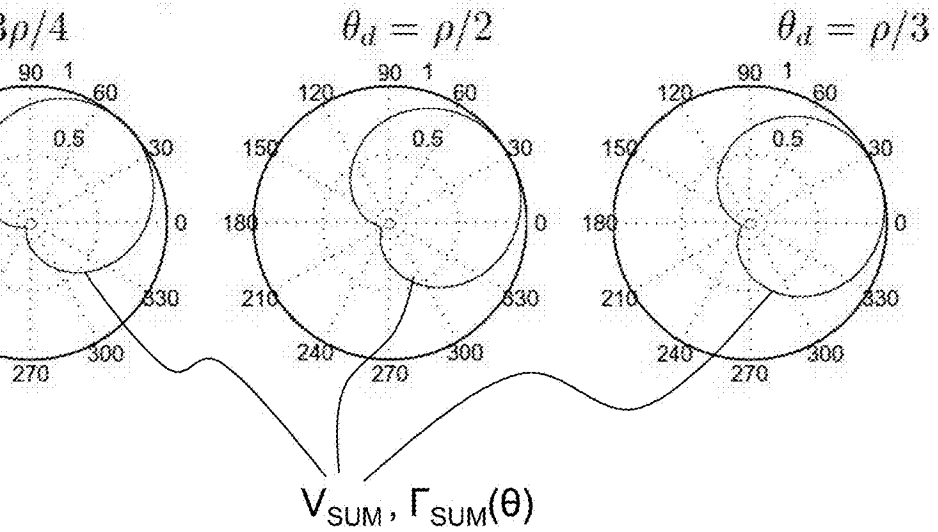
FIG. 9B show examples of sum polar patterns of a sum Virtual microphone obtained from the polar patterns of Virtual Microphones of FIG. 9A.

In FIG. 9B there are shown three different examples of sum pattern $\Gamma_{SUM}$ of a sum Virtual Microphone VSUM, identified by a respective sum signal $V_{SUM}$, obtained from the pair of Virtual Microphones $V_1$ and $V_2$ of FIG. 9A, for three different values, $3\rho/4$, $\rho/2$, $\rho/3$, of the desired direction $\theta_d$.

It can be seen from FIGS. 9A and 9B that the pattern $\Gamma_{V_1}(\theta)$ and sum pattern $\Gamma_{SUM}(\theta)$ represented in the previous examples are different, but visibly quite similar in terms of shape and area.

As mentioned, polar patterns as similar as possible are need for localization purposes, in order to compare the energy picked by the resulting Virtual Microphones aiming at different desired directions $\theta_d$.

The similarity property strongly depends on the separation angle $\rho$, which must be small enough to guarantee the desired level of similarity. Preferably the separation angle $\rho$ between the Virtual Microphones $V_1$ and $V_2$ used to obtain the sum pattern $\Gamma_{SUM}(\theta)$ is lower than $\pi/2$.

Figure 17:
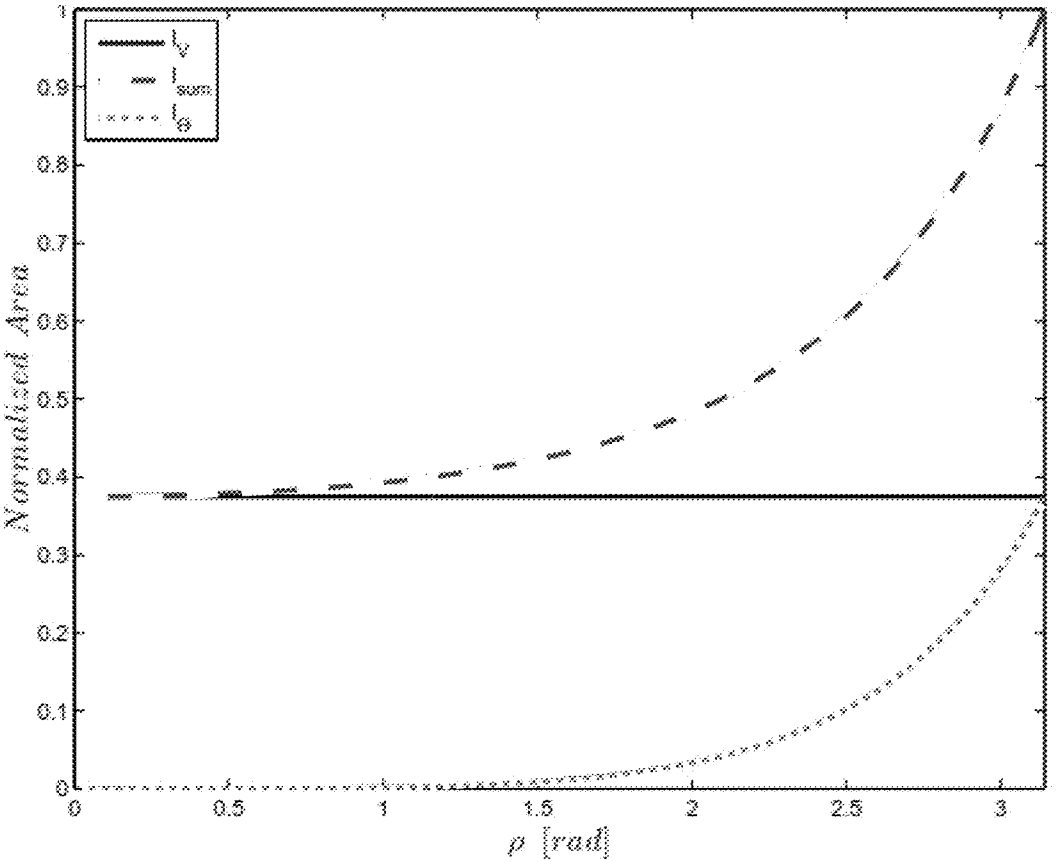
FIG. 17 is a graph showing similarity indexes of Virtual Microphones.

In FIG. 17 are shown indexes which are calculated in order to objectify the degree of similarity. Two indexes $I_{sum}$ and $I_\Theta$ measure the similarity in terms of area between the sum pattern $\Gamma$sum ($\theta$) and the pattern $\Gamma_{V_1}(\theta)$ of the Virtual Microphone of the pair determining the sum. $I_\Theta$ is obtained, as described in the following, from a function $\Theta(\theta)$, which measures the similarity in terms of shape. $I_{sum}$, and $I_\Theta$ are functions of the ratio $I_{V_1}$ between the area of $\Gamma_{V_1}(\theta)$ and the area of an omnidirectional polar pattern, which is $\pi R^2$, with radius R=1

$$I_V = \frac{1}{\pi}\int_0^{2\pi} \frac{|\Gamma_{V_1}(\theta)|^2}{2} d\theta$$

The first index $I_{sum}$ is simply the area of $\Gamma$sum ($\theta$) normalized with respect to the omnidirectional polar pattern:

$$I_{sum} = \frac{1}{2\pi}\int_0^{2\pi} |\Gamma_{sum}(\theta)|^2 d\theta$$

High area-similarity between $\Gamma_{sum}(\theta)$ and $\Gamma_{V_1}(\theta)$ requires $I_{sum} - I_{V_1}$ to be low.

The shape-similarity index function $\Theta(\theta)$ is the difference between $\Gamma_{sum}(\theta)$ and a directive polar pattern with the same shape of $\Gamma_{V_1}(\theta)$ focusing to the main direction of $\Gamma$sum ($\theta$). $\Theta(\theta)$ is mathematically defined as:

$$\Theta(\theta) = \Gamma_{sum}(\theta) - \Gamma_{V_1}(\theta - \theta_d)$$

$\Theta(\theta)$ is a function returning a similarity estimate for each angle $\theta$ and its range is $-1 \leq \Theta(\theta) \leq 1$. Lower in modulus are the values returned by $\Theta(\theta)$ higher will be the similarity. The index $I_\Theta$ is the normalized area of the function $\Theta(\theta)$:

$$I_\Theta = \frac{1}{2\pi}\int_0^{2\pi} |\Theta(\theta)|^2 d\theta$$

$$I_\Theta = \frac{1}{2\pi}\int_0^{2\pi} |\Theta(\theta)|^2 d\theta$$

High area-similarity between $\Gamma_{sum}(\theta)$ and $\Gamma_{V_1}(\theta)$ requires $I_\Theta$ to be low.

In FIG. 17, by way of example, it is shown the result of the computation of the area indexes in the case of a cardioids of the first order. The area is normalized. The shown curves are functions of the separation angle $\rho$. Qualitatively it is possible to say that the ranges of values where the index $I_V$ (solid line) is circa $I_{sum}$ (dashed line) and $I_\Theta$ (dotted line) is circa 0 correspond to values of separation $\rho$ which grant high similarity. For higher values of separation angle $\rho$ the area magnitudes of $\Gamma_V(\theta)$ and $\Gamma_{sum}(\theta)$ diverge as the area of $\Gamma_{sum}(\theta)$ grows exponentially. For this reason the separation angle $\rho$ between the at least a pair of Virtual Microphones $V_1$, $V_2$ used to obtain the sum radiation pattern $\Gamma_{SUM}(\theta)$ is selected as lower than $\pi/2$ (circa 1.57 rad).

Limiting the separation angle gives also advantages in terms of speed of computations in applications, such as the source localization described in the following. With suitable angle of separation $\rho$, the shape-similarity is so high that, for application purposes, it is possible to assume also sum pattern $\Gamma_{SUM}(\theta)$ being symmetric with respect to its central axis as $\alpha_1\Gamma_{V_1}$.

Figure 10:
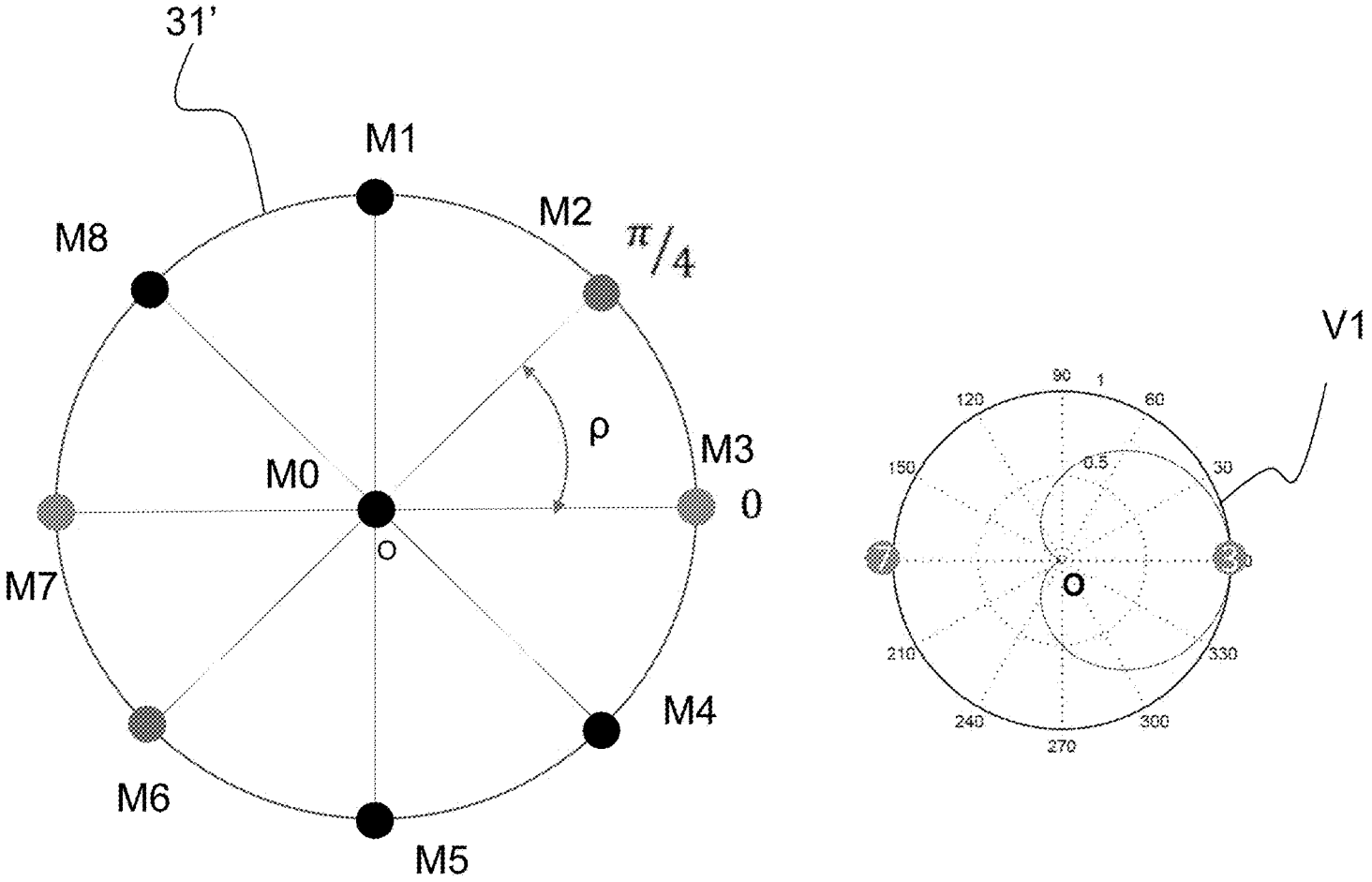
FIGS. 10, 11 and 12 shown examples of polar patterns of Virtual Microphones of the first, second and third order obtained according to embodiments of the present disclosure.
Figure 11:
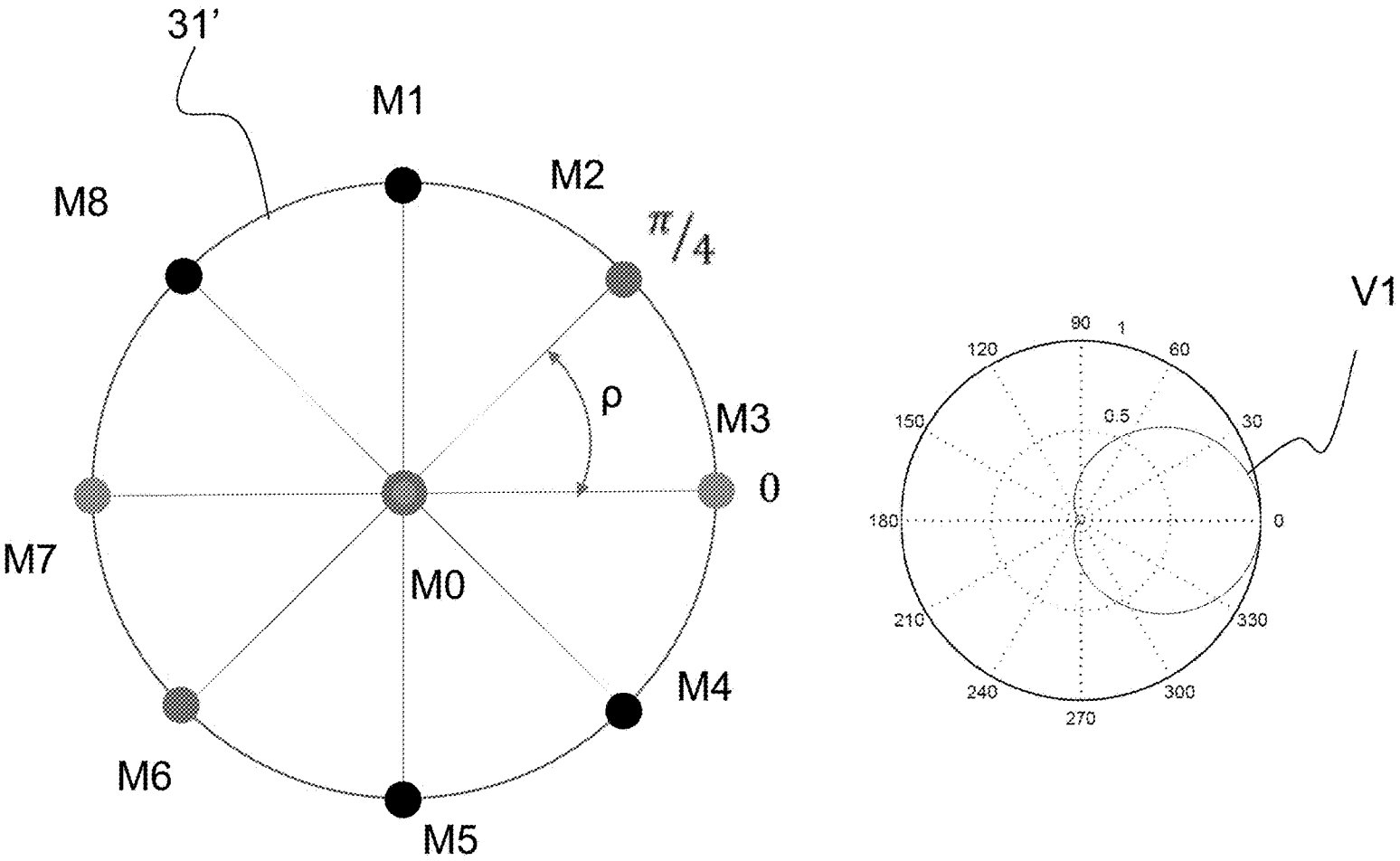
Figure 12:
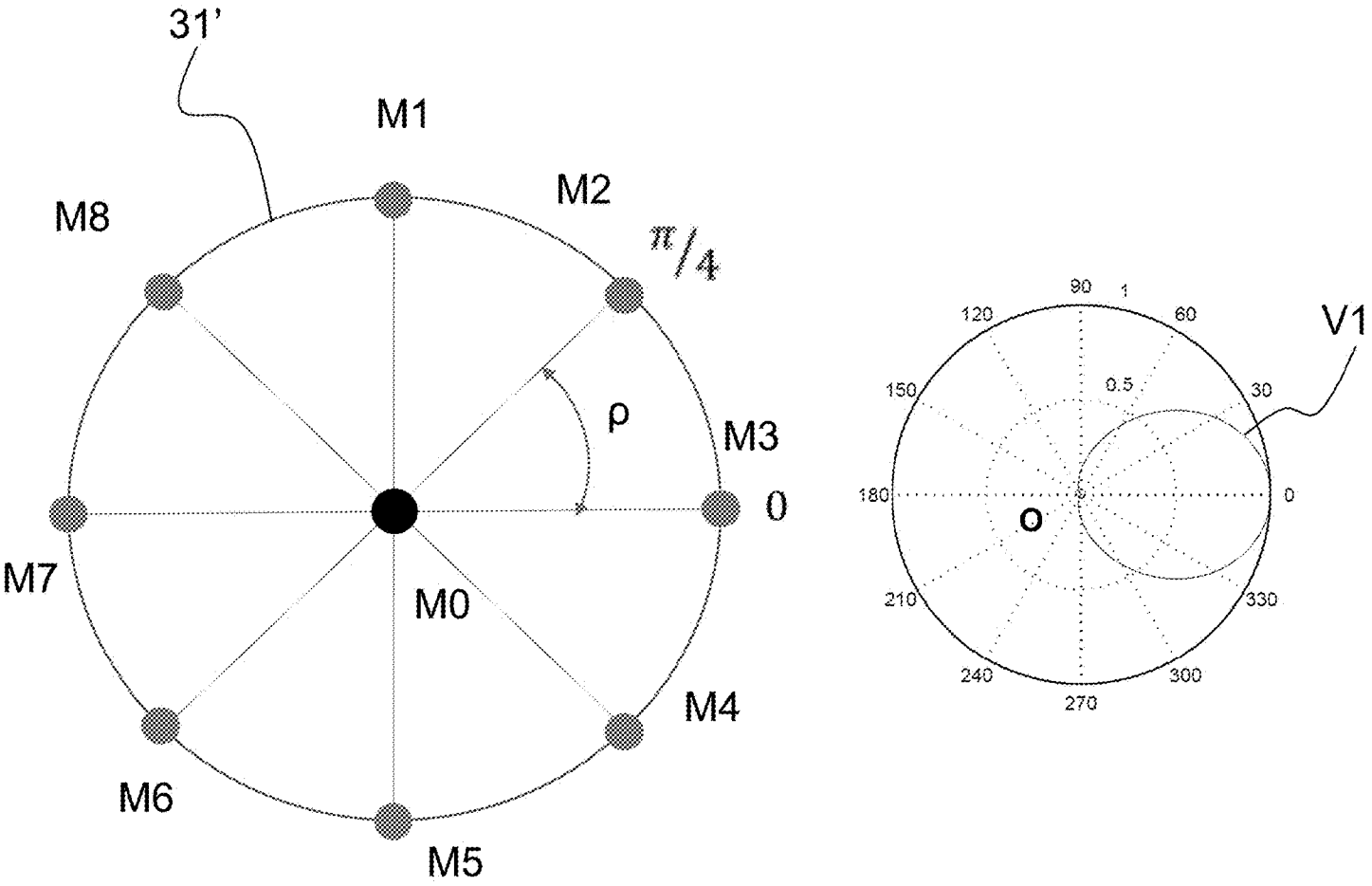

In FIGS. 10, 11 and 12 are described examples of arrays of microphones generating a pair of Virtual Microphones of the first, second and third order respectively.

As already mentioned, each array geometry is described with respect to a fixed point in the space, called "reference point" O of the array. The resulting directional Virtual Microphone will be positioned in the reference point 0. The origin of the resulting polar pattern of the Virtual Microphone is the reference point itself. For instance, in the case of ULA and UCA the reference point is the midpoint of the array.

In FIG. 10 it is shown an array 31' with microphones M0 in the center and microphones M1 . . . M8 on a circumference, like one in depicted in FIG. 6. Physical microphones M3 and M7 are used according to ULA theory to create a first order Virtual Microphone $V_1$, which radiation pattern is also shown in FIG. 10. Such radiation pattern $V_1$ points to $\theta=0$ rad. Physical microphones M2 and M6, are used to create a second first order Virtual Microphone $V_2$, which radiation pattern points to $\theta=\eta/4$ rad. It is indicated the circular sector CS which is defined by the chosen Virtual Microphones. Using different physical microphones results in addressing different sectors.

In FIG. 11 it is shown the same array 31' of FIG. 10 where physical microphones M3, M0 and M7 are used to create a second order Virtual Microphone $V_1$, which radiation pattern is also shown in FIG. 11. Such radiation pattern $V_1$ points to $\theta=0$ rad. Physical microphones M2, M0 and M6, are used to create a second first order Virtual Microphone $V_2$, which radiation pattern points to $\theta=\eta/4$ rad.

Figure 4:
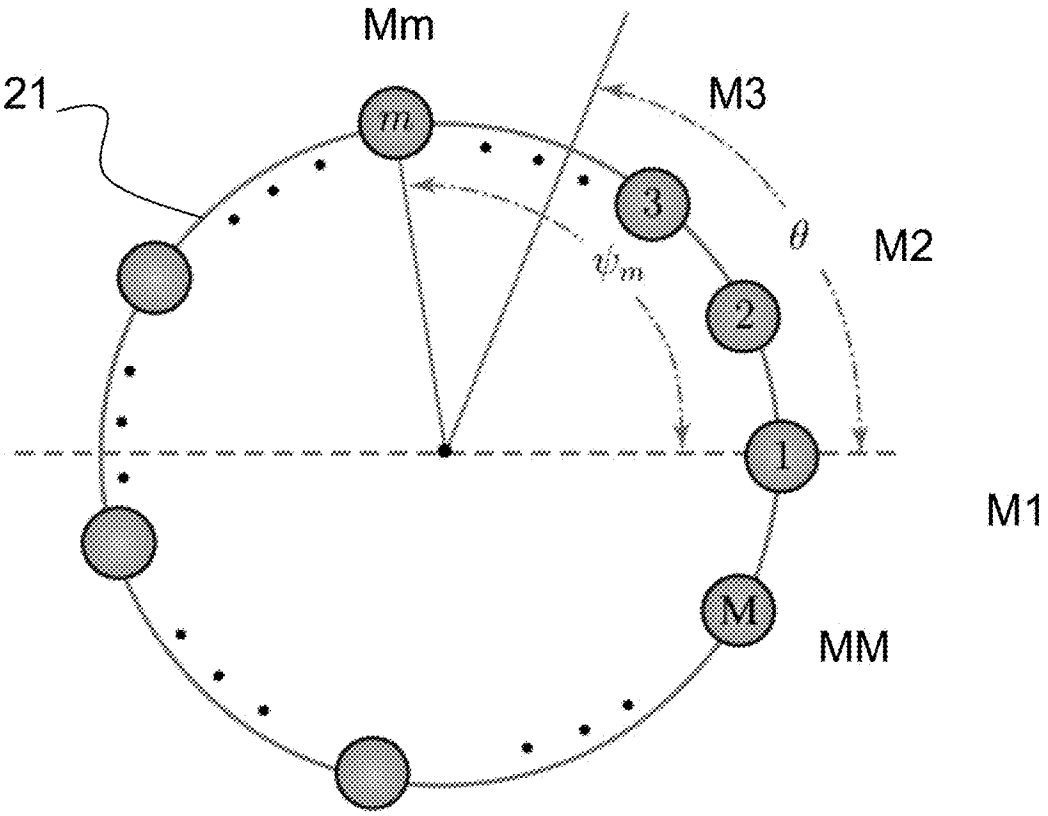
FIG. 4 (Prior Art)

In FIG. 12 it is shown the same array 31' of FIG. 10, used however as an UCA like in FIG. 4, where physical microphones M1, M2, M3, M4, M5, M6 and M7 are used to create a third order Virtual Microphone $V_1$, which radiation pattern is also shown in FIG. 12. Such radiation pattern $V_1$ points to $\theta=0$ rad. Physical microphones M1, M2, M3, M4, M5, M6 and M7, are also used to create a second first order Virtual Microphone $V_2$ which radiation pattern points to $\theta=\eta/4$ rad.

Thus, the above operations are applicable to arbitrary order Virtual Microphones, considering the example of arbitrary order cardioids. The general formula describing an N-th order cardioid polar pattern $\Gamma_C^N(\theta)$, known in the literature, is the following:

$$\Gamma_C^N(\theta)=(0.5+0.5\cos\theta)^N:$$

The corresponding polar pattern coefficients $a_i$ are:

First Order Case: $a_1=0.5$;

Second Order Case: $a_1=0.5$ $a_2=0.25$;

Third Order Case: $a_1=0.375$ $a_2=0.375$ $a_3=0.125$.

Figure 13:
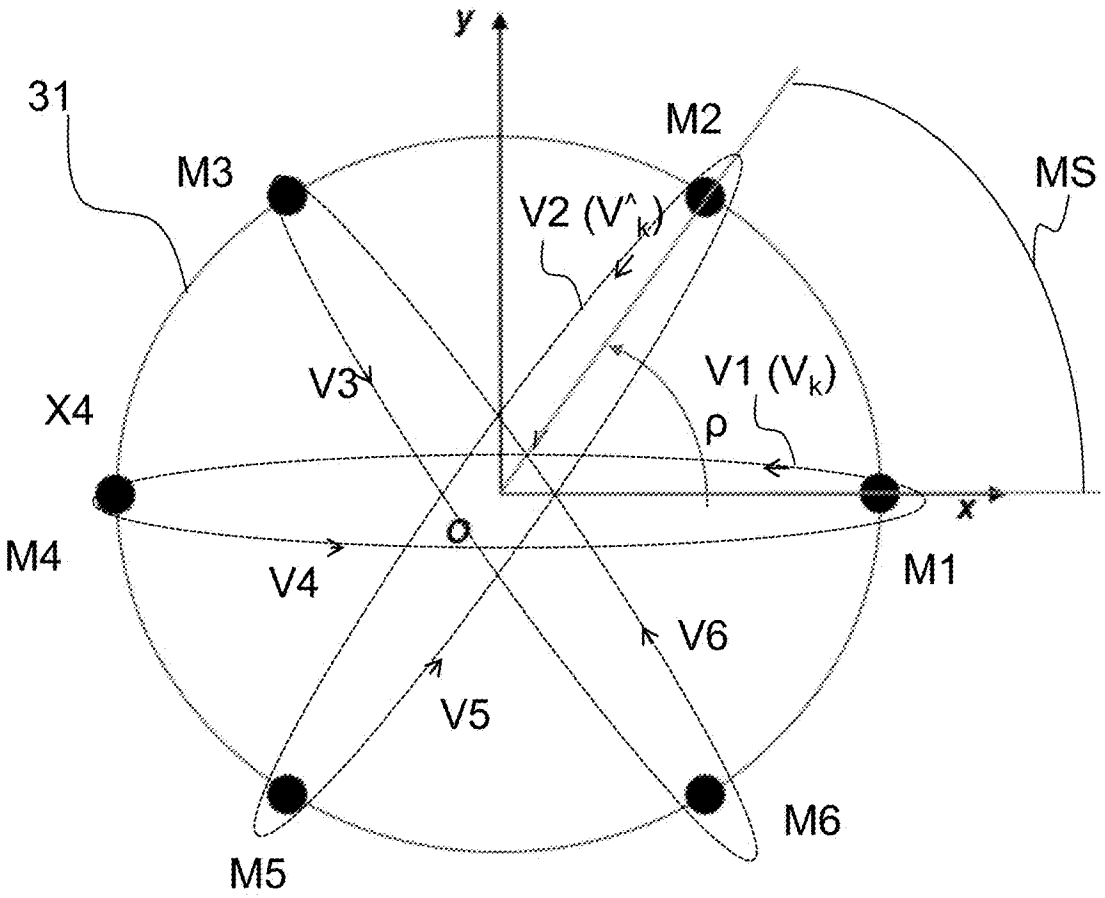
FIG. 13 shows a further schematic representation of the array of FIG. 5.
Figure 14:
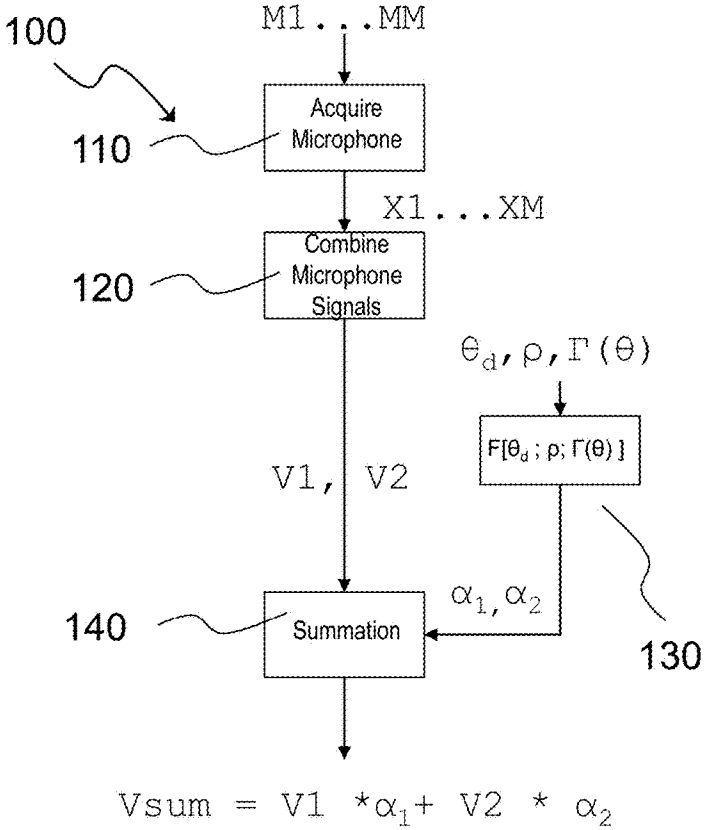
FIG. 14 shows a flow diagram representing operations methods according to embodiments of the present disclosure.

Thus, the beamforming procedure described so far, an embodiment 100 of which is indicated in the flow diagram shown in FIG. 14, starting from a plurality of omni-directional microphones, M1 . . . Mm, for instance M1 . . . M4 in FIG. 8, arranged as an array with respect to a reference point, such as ULA or UCA, where are acquired in a step 110 microphone signals X1 . . . XM, issued by said plurality of microphones which are combined, in a step 120, to obtain at least a pair of Virtual Microphones, such as Virtual Microphones $V_1$ and $V_2$, having respective patterns of radiation with a same origin corresponding to the reference point O of the array and rotated at different pattern direction angles, defining a separation angle $\rho$, so that a circular sector CS of corresponding aperture is defined between said different pattern direction angles. In general from M microphone signals X1 . . . XM can be obtained N Virtual Microphones V1 . . . VN, from which one or more pair of Virtual Microphones can be selected according to the rules and theories described with reference to previous FIGS. 4-13.

In a step 130, given the desired direction $\theta_d$, the separation angle $\rho$, and the polar pattern of radiation of the Virtual Microphones, which as seen above can be represented by the polar pattern $\Gamma_{V_1}$, the weights $\alpha_1$, $\alpha_2$ are obtained, for instance using the relationship (1) and (2), applied in $\theta_d$, $\rho$ and $\Gamma_{V_1}$:

$$\alpha_2=\frac{1}{\beta\Gamma_{V_1}(\vartheta_d)+\Gamma_{V_1}(\vartheta_d-\rho)} \tag{1}$$

$$\alpha_i=\beta\alpha_2 \tag{2}$$

where $$\beta=(\rho-\theta_d)/\theta_d$$

This are the weights required to point the weighted sum $\Gamma_{SUM}(\theta)$ of the polar patterns of the pair of Virtual Microphones $V_1$ and $V_2$ in the desired direction $\vartheta_d$, given a determined separation angle $\rho$.

Thus, the step 130 provides computing the weights $\alpha_1$, $\alpha_2$ as a function of a determined pattern direction angle $\theta_d$, of the patterns of radiation, $\Gamma_V=\Gamma_{V_1}=\Gamma_{V_2}$ since the pattern are identical, of the pair of directional Virtual Microphones $V_1$, $V_2$ and of the separation angle $\rho$ so that a main lobe of said sum radiation pattern $\Gamma_{SUM}(\theta)$ is steered within said circular sector CS to point in the direction of said determined pattern direction angle $\theta_d$.

In step 140 a sum signal $V_{SUM}=\alpha_1V_1+\alpha_2V_2$ is obtained, which is the signal observed by a virtual microphone pointing in the desired direction $\vartheta_d$ and which radiation pattern is $\Gamma_{SUM}(\theta)=\alpha_1\Gamma_{V_1}(\theta)+\alpha_2\Gamma_{V_2}(\theta)$, applying the weight computed at step 130, therefore the sum Virtual Microphone signal $V_{SUM}(\theta)$ determines a radiation pattern $\Gamma_{SUM}(\theta)$ which has its main lobe steered in the desired direction $\theta_d$ within said circular sector CS.

In other word the step 140 provides obtaining a sum signal $V_{SUM}$ of a sum Virtual Microphone to which is associated a sum radiation pattern $F_{SUM}(\theta)$, associating a respective weight $\alpha_1$, $\alpha_2$ to signals of said pair of directional Virtual Microphones $V_1$, $V_2$, obtaining respective weighted signals of radiation $\alpha_1V_1$, $\alpha_2V_2$ and summing said weighted signals $\alpha_1\Gamma_{V_1}$, $\alpha_2\Gamma_{v_2}$, in particular as:

$$V_{SUM}=\alpha_1V_1+\alpha_2V_2$$

It must be noted that there are alternative ways of calculating the weights to obtain a desired direction $\theta_d$, in particular of setting a system of equation defining conditions which solved defines a constraint for the weights. For instance a constraint can impose that the sum diagram has a maximum in the desired direction $\theta_d$, then a second constraint imposes that that sum pattern diagram has unitary value in the desired direction $\theta_d$.

Now it is described the use of such method of beamforming for performing a source localization.

In general, such method of beamforming for performing a source localization uses the steering, through the operation 140 of modifying the weights, in the circular sectors of the pattern direction angle of said sum radiation pattern to obtain a sound source location estimate, obtaining said location estimate choosing the direction on which the power of the signals of said plurality of virtual microphones is maximized.

More in detail, such estimating a source location includes choosing among directions q a direction $\hat{q}_s$ in which the power of the signals, in particular the average Teager Energy $E_T$ of the current signal frame is maximized:

$$\hat{q}_s=\underset{q}{\operatorname{argmax}}[E_T(q)]$$

$$\hat{q}_s=\underset{q}{\operatorname{argmax}}[E_T(q)]$$

where considering a time-frame of a number P of samples, the Teager Energy $E_T$ is:

$$E_T(q)[V_q]=\frac{1}{P-2}\sum_{n=2}^{P-1}V_q(n)^2-V_q(n-1)V_q(n+1)$$

$$E_T(q)[V_q]=\frac{1}{P-2}\sum_{n=2}^{P-1}V_q(n)^2-V_q(n-1)V_q(n+1)$$

where $V_q$ is the output of the Virtual Microphone focused at the q direction and n is the index of the sample. Teager Energy $E_T$ is higher for harmonic signals, so it is preferable as choice of the power measured during the steering for detecting speech signals.

A possible array geometry for doing steering employing first order Virtual Microphones in a ULA is depicted in FIG. 13, which shows an array such as the array 31 of FIG. 5. Six omni-directional microphones M1 . . . M6 issue respective microphone signals which can be combined according to the described beamforming procedure 100 to obtain Virtual Microphones.

Figure 15:
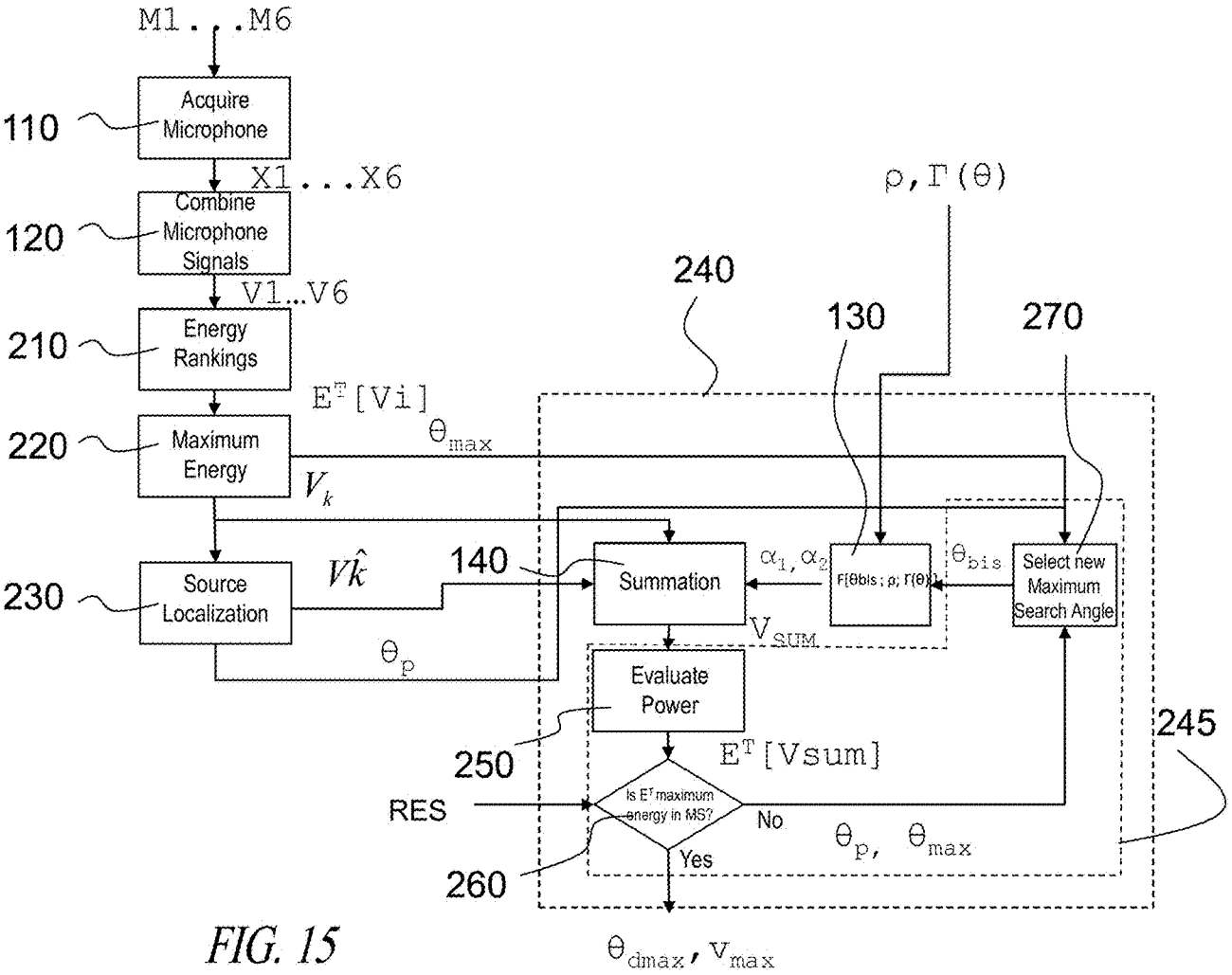
FIG. 15 shows a flow diagram representing a variant embodiment of the present disclosure.

With reference to FIG. 15, which shows a flow diagram representing an embodiment 200 of a source localization procedure, thus it is provided to acquire in a step 110 the analog microphone signals from the microphones M1 . . . M6 through analog to digital conversion obtaining digital microphone signal X1 . . . X6.

In a step 120 Virtual Microphones, in particular six Virtual Microphones $V_1 \ldots V_6$ are obtained, combining the signals X1 . . . X6 using the linear DMA theory, as described with reference to FIG. 14, i.e., applying a delay for instance to the signal X1 before summing the microphone signals, X1 and X4, which are signals of microphones placed at a given distance d, i.e., the diameter of the circumference of the array 31. Virtual Microphone $V_1$, as mentioned, is obtained by combining digital signals X1 and X4, Virtual Microphone $V_2$ is obtained by combining digital signals X2 and X5, Virtual Microphone $V_3$ is obtained by combining digital signals X3 and X6. Virtual Microphone $V_4$ is obtained by combining digital signals X4 and X1 (i.e., the combined signals are the same of Virtual Microphone $V_1$, however the delay is applied to signal X4 this time), Virtual Microphone $V_5$ is obtained by combining digital signals X5 and X2, Virtual Microphone $V_6$ is obtained by combining digital signals X5 and X2.

Thus a plurality of Virtual Microphones $V_1 \ldots V_6$ is obtained.

It must be noted that since the described method starts from an array of microphones and builds at least a pair of Virtual Microphones by taking microphones of the whole array, this can also be regarded as taking the Virtual Microphones from one sub-array (es. ULA V2, from signals X2 and X5 in FIG. 13) in a greater array (array 31) and the other from another sub-array (es. ULA $V_5$, from signals X5 and X2) in the greater array (31), it can be said that the beamforming method here described employs a plurality of microphones arranged in arrays with respect to a reference point, even if such arrays can be regarded as a single array, such as in the case of arrays 21, 31, 31', 31", 31". The number of arrays to be considered depends on the level of abstraction applied.

Then in a step 210 is performed an Energy Ranking of the Virtual Microphones, i.e., it is calculated the average Teager Energy of each directive Virtual Microphone signal $E^T[Vi(n)]$ from each Virtual Microphone. Then the six energy measures $E^T[Vi(n)]$ are sorted, building a ranking list, from the highest to the lowest energy, of ranked Virtual Microphones. The signal Vi(n) maximizing the Teager energy $E^T[Vi(n)]$ is indicated in step 220 as signal of the first Virtual Microphones $V_k$, i.e., the first element of the ranking list. In this example it is assumed that the first Virtual Microphone $V_k$ is $V_1$. In addition to select the signal $V_k$ of the Virtual Microphone $V_k$ to which corresponds the maximum Energy, the step 220 also supplies a first marked angle $\theta_{max}$ corresponding to the direction of such signal or Virtual Microphone.

Then in a step 230 it is performed a Main Circular Sector Selection considering only the signals of the Virtual Microphones adjacent to the marked first Virtual Microphone $V_k$, in the example $V_2$ and $V_6$, and selecting the adjacent Virtual Microphone which has the greater energy between the adjacent Virtual Microphones, i.e., it is in an upper position in the energy ranking list, and indicating the corresponding Virtual Microphone as second marked Virtual Microphone $V_{\hat{k}}$; in the example of FIG. 13 V2 is chosen as second marked Virtual Microphone $V_{\hat{k}}$. A Main Circular Sector MS is defined as the circular sector comprised between the first and second marked Virtual Microphone, $V_k$ and $V_{\hat{k}}$. The direction of the second marked virtual signal $V_{\hat{k}}$ defines a second marked angle $\theta_p$, which is also supplied as output at the step 230.

In a sub-procedure 240 it is then performed a continuous steering in the Main Circular Sector selected at step 230 to perform source localization, applying the steering steps of the beamforming method described previously, using the first and second marked Virtual Microphone, $V_k$ and $V_{\hat{k}}$, as the pair of Virtual Microphones input to step 140.

Assuming the main lobe directions of the radiation patterns $\Gamma_{V_k}$ Hand $\Gamma_{V\hat{k}}(\theta)$ of the first and second marked Virtual Microphone, $V_k$ and $V_{\hat{k}}$ to be respectively 0 and $\rho=\pi/3$, as indicated in FIG. 13, in line with the beamforming method previously described it is provided the step 140 of obtaining a sum radiation signal $V_{SUM}=\alpha_1 V_k+\alpha_2 V_{\hat{k}}$, which is the signal observed by a Virtual Microphone pointing in the desired direction $\vartheta_d$ and which radiation pattern is $\Gamma_{SUM}(\theta)=\alpha_1\Gamma_{Vk}(\theta)+\alpha_1\Gamma_{V\hat{k}}(\theta)$, associating a respective weight $\alpha_1$, $\alpha_2$ to signals of said pair of directional Virtual Microphones $V_k$ and $V_{\hat{k}}$, obtaining respective weighted signals $\alpha_1 V_k$, $\alpha_2 V_{\hat{k}}$ and summing said weighted signals $\alpha_1 V_k$, $\alpha_2 V_{\hat{k}}$, obtaining the signal of the sum Virtual Microphone $V_{SUM}$ as $$V_{SUM}=\alpha_1 V_k+\alpha_2 V_{\hat{k}}.$$

In the sub-procedure 240 it is also provided the step of computing 130 said weights $\alpha_1$, $\alpha_2$ as a function of a determined or desired pattern direction angle $\theta_d$, which however in this case is a maximum search angle $\theta_{bis}$ direction, i.e., the new direction along which the maximum is searched, calculated by a maximum energy finding procedure 245, and of the separation angle $\rho$ so that a main lobe of said sum radiation pattern $\Gamma_{SUM}(\theta)$ is steered within the circular sector, in this case the Main Circular Sector MS, to point in the direction of said desired angle $\theta_d$, i.e., maximum search angle $\theta_{bis}$.

Thus, as shown in FIG. 15, after the step 140 is evaluated in a step 250 the power of the sum signal $V_{SUM}$ in the desired direction, in particular is evaluated the Teager Energy $E^T$ of the sum signal $V_{SUM}$.

Then in a step 260 is evaluated if the Teager Energy $E^T$ of the sum signal $V_{SUM}$ is the maximum energy in the Main Sector MS. As better detailed in the following this evaluation step 260 is preferably part of an iterative procedure, and in this case the resolution of the iterative procedure is controlled by a resolution parameter RES supplied to the step 260 for the evaluation.

In the affirmative the location estimate, i.e., the maximizing direction $\theta_{dmax}$ which corresponds to the desired direction, is found. The maximizing direction $\theta_{dmax}$ is the source location estimate in radians. Also the evaluation step 260 supplies the corresponding signal $V_{max}$ of the sum radiation pattern $\Gamma_{SUM}(\theta)$ pointed in the maximizing direction $\theta_{dmax}$.

In the negative a new maximum search angle direction $\theta_{bis}$ is selected in a step 270 and in the step 130 the weights $\alpha_1$ $\alpha_2$ supplied to step 140 to steer the sum pattern $\Gamma_{SUM}(\theta)$ are computed on the basis of such new maximum search angle $\theta_{bis}$. Such weights are for instance the solution of $[\alpha_1\ \alpha_2]=\Gamma[\theta_{bis};\ \rho;\ \Gamma(\theta)]$, as indicated in the pseudocode examples that follows.

In the example of FIG. 15, as mentioned, from steps 220 a first marked angle $\theta_{max}$ is supplied to the step 270 which determines the new maximum search angle direction $\theta_{bis}$, which corresponds to the direction of the first marked Virtual Microphone, while a second marked angle $\theta_p$, corresponding to the direction of the second marked Virtual Microphone $V_{\hat{k}}$, is passed from step 230 to the same step 270. This is performed so that the step 270 can choose the new maximum search direction $\theta_{bis}$, i.e., the desired direction $\theta_d$, to which point the sum radiation pattern through steps 130 and 140, within the Main Circular sector MS defined between the first marked angle $\theta_{max}$ and the second marked angle $\theta_p$. As better explained with reference to the pseudo-code examples that follows, this is in particular obtained by bisecting iteratively the Main Circular Sector. The step 270 supplying the maximum estimate $\theta_{bis}$ supplies the bisecting angle $\theta_{bis}=(\theta_{max}+\theta_p)/2$ at the first iteration, while in the subsequent iterations updates of the first marked angle $\theta_{max}$ and the second marked angle $\theta_p$ are supplied by the evaluation step 260.

Therefore, the localization procedure 200 is a variant of the beamforming procedure 100, which adds a ranking procedure (steps 210-230), after steps 110-120 forming pairs of Virtual Microphones from the microphones signal, to identify a pair of Virtual Microphones defining a Main Sector MS, which has the maximum probability of including the maximizing direction $\theta_{dmax}$. This main sector MS corresponds to the Circular Sector CS of the beamforming procedure 100, thus it is supplied to the beamforming steps 130-140, which determine a sum radiation pattern steerable within said Circular Sector CS, i.e., Main Sector NS. These steps 130-140 are performed under the control of a maximum energy finding procedure 245 including the steps 250-270.

The pseudo-code of such procedure is presented in the following, assuming the main lobe directions of the radiation patterns $\Gamma_{Vk}(\theta)$ and $\Gamma_{V\hat{k}}(\theta)$ of the first and second marked Virtual Microphone, $V_k$ and $V_{\hat{k}}$ to be respectively 0 and ρ, as found by procedure 220 and 230.

$V_{max}=V_k$;
$E_{Tmax}=E_T[V_k]$;
$\theta_{max}=\theta$;/*as evaluated by step 220*/
$\theta_p=\rho$;/*as evaluated by step 230*/
$\theta_{dmax}=\theta_{max}$;
For j=1; j<RES; j++
$\theta_{bis}=(\theta_{max}+\theta_p)/2$;
$[\alpha_1\alpha_2]=\Gamma[\theta_{bis};\ \rho;\ \Gamma(\theta)]$;
$V_{SUM}=\alpha_1 V_k+\alpha_2 V_{\hat{k}}$;
If $(E_T[Vsum]>E_{Tmax})$
$E_{Tmax}=E_T[V_{sum}]$;
$V_{max}=V_{sum}$;
$\theta_p=\theta_{max}$;
$\theta_{max}=\theta_{bis}$;
else
$\theta_p=\theta_{bis}$;
endIf
endFor
$\theta_{dmax}=\theta_{max}$ $V_{max}$ in the pseudocode is in general the output signal, which varies in time, of the beamformer driven by the localization procedure. $E_{Tmax}$ is a variable indicating the maximum value taken by the Teager energy $E_T$. $\theta_{bis}$, the maximum search angle, is the new desired direction at a given iteration step j of the procedure 240, i.e., of the maximum energy finding procedure 245 which then reiterates steps 130 and 140.

Such steps 250-270, i.e., the maximum energy finding procedure 245, to find the maximizing direction $\theta_{dmax}$, are preferably performed by an iterative procedure, which in particular, provides, starting from the first marked Virtual Microphone $V_k$, defining as first boundary of the Main Circular Sector MS, which direction is assumed as initial maximizing direction $\theta_{dmax}$ and the corresponding Teager energy the maximum energy $E_{Tmax}$, selecting a new steering direction $\theta_{bis}$, preferably pointing at half the separation angle ρ of the Main Circular Sector MS, between the direction of the first marked Virtual Microphone $V_{\hat{k}}$ and the direction of the second marked $V_{\hat{k}}$Virtual Microphone, which defines the second boundary direction $\theta_p$, i.e., bisecting the Main Circular Sector MS in two equal subsectors, or in any case dividing the Main Circular Sector MS in two sub-sectors Then the weighted sum Virtual Microphone $V_{SUM}$ is obtained from the two marked Virtual Microphones pointing in that direction, i.e., it is performed the steering in the Main circular Sector MS according the beamforming method described above. Then the energy of the weighted Virtual Microphone $V_{SUM}$ in that direction is evaluated, and if greater than the maximum energy $E_{Tmax}$, the corresponding direction is selected as new maximizing direction $\theta_{max}$. A new circular sector, which is a subsector of the main sector, defined between the new maximizing direction $\theta_{max}$ and the previous maximizing direction, which becomes the second boundary direction $\theta_p$, is selected and the procedure including steering the sum pattern in a direction inside the subsector, in particular in the middle of the subsector, and evaluating the energy is repeated. If the energy of the weighted Virtual Microphone $V_{SUM}$ is minor than the maximum energy $E_{Tmax}$, the remaining circular subsector of the two subsector obtained by setting the maximum search angle or steering direction angle $\theta_{bis}$, is chosen to repeat the procedure, i.e., the sector having as second boundary direction $\theta_p$ equal to the current steering direction $\theta_{bis}$, while the value of $\theta_{max}$ is maintained. The procedure is repeated for a given number of times.

As mentioned with reference to FIG. 15, it is possible to choose a predefined resolution RES for the localization process, where RES is a positive integer. Higher is the predefined resolution RES, higher will be the direction resolution. The resolution RES corresponds for instance to the number of iterations to be performed.

In the pseudocode described it is referred to a function $F[\theta bis;\ \rho;\ \Gamma(\theta)]$ as a function which takes as input the desired direction $\theta_d$ of the resulting sum Virtual Microphone $V_{SUM}$, the polar pattern $\Gamma(0)$ which is the polar of one of the two Virtual Microphones of the pair, for instance the pattern $F_{Vk}(\theta)$ of the first marked Virtual Microphone $V_k$, and the separation angle ρ between the two marked Virtual Microphones $V_k$ and $V_{\hat{k}}$ and returns the appropriate weights $\alpha_1$, $\alpha_2$ according to the constraint (1), i.e., $\alpha_2=1/(\beta\Gamma V_1(\theta_d)+\Gamma_{V_1}(\theta_d-\rho))$. In other words, the function F corresponds to the function implemented by the operation 130 of computing the respective weights $\alpha_1$, $\alpha_2$ as a function of a determined pattern direction angle $\theta_d$, or $\theta_{bis}$, and of the separation angle ρ so that a main lobe of said sum radiation pattern $\Gamma_{SUM}(\theta)$ is steered within said circular sector CS to point in the direction of said determined pattern direction angle $\theta_d$ in the beamforming method described above.

The third step of steering in the Main Circular Sector and the search of the direction maximizing the Teager Energy can of course be performed also using different maximum search algorithms. A remarkable property of the presented source-localization method is that in principle any steering resolution can be chosen.

Figure 16:
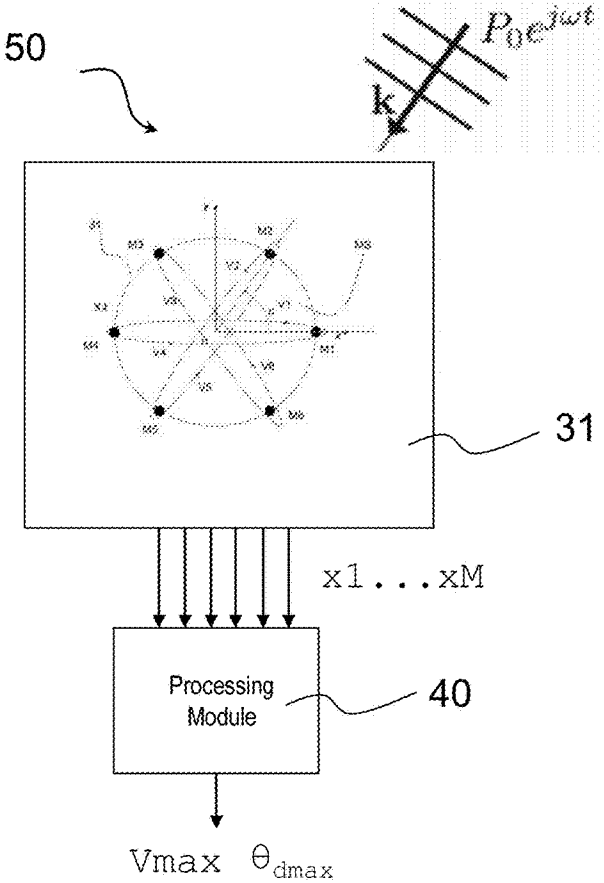
FIG. 16 shows schematically an apparatus implementing methods according to embodiments of the present disclosure.

FIG. 16 shows schematically an apparatus 50 implementing the method here described. With 31 is indicated an array 31, which is the one shown in FIG. 5, with six physical microphones M1 . . . M6. However it can be any set of directional microphones arranged as an array with respect to a reference point and at a distance d one with respect the other, the distance d being negligible than the wavelength of the sound wave of pressure amplitude P0 and frequency ω incoming along a propagation vector k to be detected, as also described with reference to FIG. 1. Preferably it is a DMA array, in particular a DMA-ULA or DMA-UCA. Such an array 31 supplies the signals of the microphones, X1 . . . XM, which are in the example analog signals, to a processing module 40. Such processing module 40 is preferably a microprocessor or microcontroller configured to implement the operations of beamforming method 100 or the localization method 200, in particular building the Virtual Microphones according to the order required, obtaining the sum Virtual Microphone to be steered, and performing the steering, in particular with the aim of localizing the direction of arrival of the sound wave P0. The processing module 40 can be alternatively a DSP or any other processing module suitable to implement the operations of the methods 100 and/or 200. The processing module can be included in one or more computer as well.

Therefore, the described solution allows to build arbitrary-order-DMA-based parametric sound source localization systems which allow doing steering in a continuous fashion in all directions.

The described beamforming solution allows to build polar patterns of any order which are similar to each other, aiming at arbitrary directions, this being in particular highly desirable for localization purposes. The direction of the resulting beam can be easily adjusted simply changing the constrained weights of the polar pattern addends: only one tuning parameter is necessary.

The described solution for what regards localization systems has the following desirable features: beamforming and source localization are applicable simultaneously; the localization accuracy is theoretically arbitrarily selectable; localization resolution is tunable in a parametric fashion.

Also the described solution avoids high computational complexity limits due to performing the maximum search scanning all the directions. The DMA-based beamformer which can be steered in a continuous fashion substantially resolves the problems of computational complexity since the beams are characterized by a 2D shape: in fact during an iterative localization procedure, the system may be tuned in order to find the desired trade-off between accuracy and resource consumption. This means that the first iterations give already a right estimate of the direction of arrival, although characterized by low resolution.

Of course, without prejudice to the principle of the embodiments, the details of construction and the embodiments may vary widely with respect to what has been described and illustrated herein purely by way of example, without thereby departing from the scope of the present embodiments, as defined the ensuing claims.

Embodiments of the present disclosure are particularly suitable, but not limited to, systems based on Differential Microphone Array (DMA) techniques. Such techniques are applicable to arrays where the distances between microphones are negligible with respect to the wavelength of the sound waves of interest. Due to their small dimensions MEMS microphones are particularly suitable for these applications.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A beamforming method employs a plurality of microphones arranged in an array or in arrays with respect to a reference point, the method comprises:

acquiring microphone signals issued by said plurality of microphones and combining said microphone signals to obtain Virtual Microphones;

combining said microphone signals to obtain at least a pair of directional Virtual Microphones having respective signals determining respective patterns of radiation with a same origin corresponding to said reference point of the array and rotated at different pattern direction angles, defining a separation angle between them so that at least a circular sector is defined between said different pattern direction angles, said separation angle between the at least a pair of Virtual Microphones being lower than $\pi/2$; and obtaining a sum radiation signal of a sum Virtual Microphone, to which is associated a respective sum radiation pattern, associating a respective weight to the signals of said pair of directional Virtual Microphones, obtaining respective weighted signals of radiation and summing said weighted signals, computing said respective weights as a function of a determined pattern direction angle of the pattern of radiation ($\Gamma_{V1}$, $\Gamma_{V2}$) of said pair of directional Virtual Microphones and of the separation angle so that a main lobe of said sum radiation pattern is steered within said circular sector to point in the direction of said determined pattern direction angle.

2. The method according to claim 1, further comprising arranging said array as a Differential Microphone Array.

3. The method according to claim 2, wherein arranging said array as a Differential Microphone Array comprises arranging said Differential Microphone Array as a Uniform Linear Array or a Uniform Circular Array.

4. The method according to claim 3, further comprising steering in said circular sector the pattern direction angle of said sum radiation pattern to obtain a sound source location estimate; and obtaining said sound source location estimate by selecting the direction on which the power of the signal of said sum Virtual Microphone is maximized.

5. The method according to claim 4, further comprising, after combining said microphone signals to obtain Virtual Microphones, ranking the power of the signals of said Virtual Microphones, selecting a main circular sector defined by two adjacent virtual microphones on the basis of said ranking, and performing a continuous steering of the direction angles of said sum Virtual Microphone in said selected main circular sector to find said sound source location estimate.

6. The method according to claim 5, wherein said ranking of the power signals of said Virtual Microphones includes obtaining a ranking list as a function of power of the virtual microphones starting from a virtual microphone (Vk) which maximizes the power; and wherein selecting the main circular sector includes selecting said virtual microphone which maximizes the power and, among the virtual microphones adjacent to said microphone, selecting the virtual microphone associated with the maximum power, defining the main circular sector as the sector comprised between said virtual microphone which maximizes the power and said adjacent microphone.

7. The method according to claim 6, further comprising calculating said power as the Teager energy of the signal of the Virtual Microphone measured over a given time-frame of a given number of samples.

8. The method according to claim 7, wherein performing the continuous steering of the direction angles of said sum Virtual Microphone in said selected main circular sector to find said sound source location estimate includes evaluating the power of the signal of the sum pattern in the desired direction, then evaluating if the evaluated power is the maximum energy in the main circular sector, in the negative selecting a new desired direction by said operation of modifying the weights to steer the sum pattern.

9. The method according to claim 8, wherein the method further comprises evaluating the power of the signal and evaluating if the evaluated power is the maximum power iteratively, the number of iterations being controlled by a selectable resolution parameter.

10. A beamforming apparatus, comprising:

a plurality of microphones arranged in an array or in arrays, each microphone configured to generate a microphone signal;

a processing module configured to receive the microphone signals from said plurality of microphones and to combine said microphone signals to obtain Virtual Microphones (V1 . . . VN), wherein said module is further configured to:

combine said microphone signals to obtain at least a pair of directional Virtual Microphones having respective patterns of radiation with a same origin corresponding to a reference point of the array and rotated at different pattern direction angles defining a separation angle between them so that at least a circular sector is defined between said different pattern direction angles, said separation angle between the at least a pair of Virtual Microphones being less than $\pi/2$; and obtain a sum radiation signal of a sum Virtual Microphone, to which is associated a respective sum radiation pattern, associate a respective weight to the signals of said pair of directional Virtual Microphones, obtain respective weighted signals of radiation and sum said weighted signals, compute said respective weights as a function of a determined pattern direction angle of the pattern of radiation of said pair of directional Virtual Microphones and of the separation angle so that a main lobe of said sum radiation pattern is steered within said circular sector to point in the direction of said determined pattern direction angle.

11. The beamforming apparatus according to claim 10, wherein the processing module includes in a source localization apparatus configured to:

steer in said circular sector the pattern direction angle of said sum radiation pattern to obtain a sound source location estimate; and obtain said sound source location estimate and select the direction on which the power of the signal of said sum Virtual Microphone is maximized.

12. The beamforming apparatus according to claim 11, wherein said source localization apparatus is further configured, after the apparatus has combine said microphone signals (x1 . . . xM) to obtain Virtual Microphones (V1 . . . VN), to:

rank the power of the signals of said Virtual Microphones, select a main circular sector defined by two adjacent virtual microphones on the basis of said ranking results, and perform a continuous steering of the direction angles of said sum Virtual Microphone in said selected main circular sector to find said sound source location estimate.

13. The beamforming apparatus according to claim 11, wherein said array comprises a Differential Microphone Array.

14. The beamforming apparatus according to claim 13, wherein the Differential Microphone Array comprises one of a Uniform Linear Array and a Uniform Circular Array.

15. The beamforming apparatus according to claim 14, wherein the processing module is further configured to steer in said circular sector the pattern direction angle of said sum radiation pattern to obtain a sound source location estimate, and to select the direction on which the power of the signal of said sum Virtual Microphone is maximized to obtain said sound source location estimate.

16. The beamforming apparatus according to claim 15, wherein the processing module is further configured to rank the power of the signals of said Virtual Microphones and to select a main circular sector defined by two adjacent virtual microphones on the basis of said ranking, and to perform a continuous steering of the direction angles of said sum Virtual Microphone in said selected main circular sector to find said sound source location estimate.

17. The beamforming apparatus according to claim 16, wherein the processing module is further configured to obtain a ranking list as a function of power of the virtual microphones starting from a virtual microphone (Vk) which maximizes the power, to select said virtual microphone which maximizes the power, and, further configured to select, from among the virtual microphones adjacent to said microphone, the virtual microphone associated with the maximum power to define the main circular sector as the sector comprised between said virtual microphone which maximizes the power and said adjacent microphone.

18. The beamforming apparatus according to claim 17, wherein the processing module is further configured to determine said power as the Teager energy of the signal of the Virtual Microphone measured over a given time-frame of a given number of samples.

19. The beamforming apparatus according to claim 10, wherein the processing module comprises a digital signal processor.

20. A non-transitory computer program product that can be loaded into the memory of at least one computer and comprises portions of software code suitable for, when the program is run on the at least one computer, executing the method comprising:

receiving microphone signals from a microphone array including a plurality of microphones;

combining the microphone signals to form a pair of directional virtual microphones having respective signals determining respective patterns of radiation with a same origin corresponding to a reference point of the microphone array and rotated at different pattern direction angles;

defining a separation angle between the patterns so that at least a circular sector is defined between the different pattern direction angles, the separation angle between the at least a pair of directional virtual microphones being less than approximately $\pi/2$;

determining a sum radiation signal of a sum virtual microphone having an associated sum radiation pattern;

associating a respective weight to the signals of the pair of directional virtual microphones;

determining respective weighted signals of radiation and summing the weighted signals;

computing the respective weights as a function of a determined pattern direction angle of the pattern of radiation of the pair of directional virtual microphones and of the separation angle so that a main lobe of the sum radiation pattern is steered within the circular sector to point in the direction of the determined pattern direction angle.

* * * * *